US008323049B2

(12) United States Patent
Ngo

(10) Patent No.: US 8,323,049 B2
(45) Date of Patent: Dec. 4, 2012

(54) ELECTRICAL CONNECTOR HAVING POWER CONTACTS

(75) Inventor: Hung Viet Ngo, Harrisburg, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/694,047

(22) Filed: Jan. 26, 2010

(65) Prior Publication Data

US 2010/0197166 A1 Aug. 5, 2010

Related U.S. Application Data

(60) Provisional application No. 61/148,646, filed on Jan. 30, 2009.

(51) Int. Cl.
*H01R 13/73* (2006.01)

(52) U.S. Cl. ..... 439/552

(58) Field of Classification Search ..... 439/552, 439/638, 855, 752

See application file for complete search history.

(56) References Cited

U.S. PATENT DOCUMENTS

| | | | |
|---|---|---|---|
| 318,186 | A | 5/1885 | Hertzog |
| 741,052 | A | 10/1903 | Mahon |
| 1,477,527 | A | 12/1923 | Raettig |
| 2,248,675 | A | 7/1941 | Huppert |
| 2,430,011 | A | 11/1947 | Gillentine |
| 2,759,163 | A | 8/1956 | Ustin |
| 2,762,022 | A | 9/1956 | Benander et al. |
| 2,844,644 | A | 7/1958 | Soule, Jr. |
| 3,011,143 | A | 11/1961 | Dean |
| 3,157,448 | A | 11/1964 | Crimmins et al. |
| 3,178,669 | A | 4/1965 | Roberts |
| 3,208,030 | A | 9/1965 | Evans et al. |
| 3,286,220 | A | 11/1966 | Marley et al. |
| 3,411,127 | A | 11/1968 | Adams |
| 3,420,087 | A | 1/1969 | Hatfield et al. |
| 3,497,850 | A | 2/1970 | Gallo, Sr. |
| 3,514,740 | A | 5/1970 | Filson et al. |
| 3,538,486 | A | 11/1970 | Shlesinger, Jr. |
| 3,634,811 | A | 1/1972 | Teagno |
| 3,669,054 | A | 6/1972 | Desso et al. |
| 3,692,994 | A | 9/1972 | Hirschmann et al. |
| 3,748,633 | A | 7/1973 | Lundergan |
| 3,750,092 | A | 7/1973 | Bury |

(Continued)

FOREIGN PATENT DOCUMENTS

DE 1665181 4/1974

(Continued)

OTHER PUBLICATIONS

U.S. Appl. No. 12/317,336, filed Dec. 22, 2008, Minich.

(Continued)

*Primary Examiner* — Jean F Duverne
(74) *Attorney, Agent, or Firm* — Woodcock Washburn LLP

(57) ABSTRACT

An electrical power connector is provided that is configured to mate with a complementary electrical connector. The electrical power connector includes a connector housing that retains both electrical signal contacts and electrical power contacts. The electrical power connector includes an engagement assembly that includes 1) at least one polarization member configured to mate with a polarization member of the complementary electrical connector only when the electrical power connector is in a desired orientation relative to the complementary electrical connector, and 2) a securement member configured to releasably engage a securement member of the complementary electrical connector.

22 Claims, 9 Drawing Sheets

U.S. PATENT DOCUMENTS 3,789,348 A 1/1974 Lenaerts et al.
3,845,451 A 10/1974 Neidecker
3,871,015 A 3/1975 Lin et al.
3,910,671 A 10/1975 Townsend
3,942,856 A 3/1976 Mindheim et al.
3,944,312 A 3/1976 Koenig
3,972,580 A 8/1976 Pemberton et al.
3,998,517 A 12/1976 Griffin
4,005,923 A 2/1977 Davis, Jr.
4,070,088 A 1/1978 Vaden
4,073,564 A 2/1978 Davis, Jr.
4,076,362 A 2/1978 Ichimura
4,082,407 A 4/1978 Smorzaniuk et al.
4,130,327 A 12/1978 Spaulding
4,136,919 A 1/1979 Howard et al.
4,159,861 A 7/1979 Anhalt
4,217,024 A 8/1980 Aldridge et al.
4,227,762 A 10/1980 Scheiner
4,260,212 A 4/1981 Ritchie et al.
4,288,139 A 9/1981 Cobaugh et al.
4,371,912 A 2/1983 Guzik
4,383,724 A 5/1983 Verhoeven
4,402,563 A 9/1983 Sinclair
4,403,821 A 9/1983 Zimmerman et al.
4,473,113 A 9/1984 Whitfield et al.
4,500,160 A 2/1985 Bertsch
4,505,529 A 3/1985 Barkus
4,533,187 A 8/1985 Kirkman
4,536,955 A 8/1985 Gudgeon
4,545,610 A 10/1985 Lakritz et al.
4,552,425 A 11/1985 Billman
4,560,222 A 12/1985 Dambach
4,564,259 A 1/1986 Vandame
4,596,433 A 6/1986 Oesterheld et al.
4,603,930 A 8/1986 Ito
4,626,637 A 12/1986 Olsson et al.
4,659,158 A 4/1987 Sakamoto et al.
4,669,801 A 6/1987 Worth
4,685,886 A 8/1987 Denlinger et al.
4,689,718 A 8/1987 Maue et al.
4,709,976 A 12/1987 Nakama et al.
4,717,360 A 1/1988 Czaja
4,767,344 A 8/1988 Noschese
4,776,803 A 10/1988 Pretchel et al.
4,780,088 A 10/1988 Means
4,782,893 A 11/1988 Thomas
4,790,763 A 12/1988 Weber et al.
4,790,764 A 12/1988 Kawaguchi et al.
4,815,987 A 3/1989 Kawano et al.
4,818,237 A 4/1989 Weber
4,820,169 A 4/1989 Weber et al.
4,820,182 A 4/1989 Harwath et al.
4,838,809 A 6/1989 Mouissie
4,845,592 A 7/1989 Himes, Jr. et al.
4,850,884 A 7/1989 Sawai et al.
4,867,696 A 9/1989 Demler et al.
4,867,713 A 9/1989 Ozu et al.
4,875,865 A 10/1989 Demler et al.
4,878,611 A 11/1989 LoVasco et al.
4,881,905 A 11/1989 Demler, Jr. et al.
4,900,271 A 2/1990 Colleran et al.
4,907,990 A 3/1990 Bertho et al.
4,915,641 A 4/1990 Miskin et al.
4,917,625 A 4/1990 Haile
4,941,830 A 7/1990 Tkazyik et al.
4,950,186 A 8/1990 Kaley et al.
4,954,090 A 9/1990 Shimochi
4,963,102 A * 10/1990 Gettig et al. ..... 439/291
4,965,699 A 10/1990 Jordan et al.
4,968,263 A 11/1990 Silbernagel et al.
4,973,257 A 11/1990 Lhotak
4,973,271 A 11/1990 Ishizuka et al.
4,974,119 A 11/1990 Martin
4,975,084 A 12/1990 Fedder et al.
4,979,074 A 12/1990 Morley et al.
5,016,968 A 5/1991 Hammond et al.
5,024,610 A 6/1991 French et al.
5,035,639 A 7/1991 Kilpatrick et al.
5,046,960 A 9/1991 Fedder et al.
5,052,953 A 10/1991 Weber
5,066,236 A 11/1991 Broeksteeg
5,077,893 A 1/1992 Mosquera et al.
5,082,459 A 1/1992 Billman et al.
5,094,634 A 3/1992 Dixon et al.
5,104,329 A 4/1992 Brown et al.
5,104,332 A 4/1992 McCoy
5,107,328 A 4/1992 Kinsman
5,108,301 A 4/1992 Torok
5,137,959 A 8/1992 Block et al.
5,139,426 A 8/1992 Barkus et al.
5,151,056 A 9/1992 McClune
5,152,700 A 10/1992 Bogursky et al.
5,158,471 A 10/1992 Fedder et al.
5,174,770 A 12/1992 Sasaki et al.
5,194,480 A 3/1993 Block et al.
5,196,987 A 3/1993 Webber et al.
5,207,591 A 5/1993 Ozaki et al.
5,213,518 A 5/1993 Weidler
5,213,868 A 5/1993 Liberty et al.
5,214,308 A 5/1993 Nishiguchi
5,238,414 A 8/1993 Yaegashi et al.
5,254,012 A 10/1993 Wang
5,274,918 A 1/1994 Reed
5,276,964 A 1/1994 Anderson, Jr. et al.
5,281,168 A 1/1994 Krehbiel et al.
5,286,212 A 2/1994 Broeksteeg
5,295,843 A 3/1994 Davis et al.
5,298,791 A 3/1994 Liberty et al.
5,302,135 A 4/1994 Lee
5,321,582 A 6/1994 Casperson
5,352,133 A * 10/1994 Sampson ..... 439/357
5,358,422 A 10/1994 Schaffer et al.
5,362,249 A 11/1994 Carter
5,376,012 A 12/1994 Clark
5,381,314 A 1/1995 Rudy, Jr. et al.
5,400,949 A 3/1995 Hirvonen et al.
5,403,206 A 4/1995 McNamara et al.
5,403,210 A 4/1995 Hasegawa
5,427,543 A 6/1995 Dynia
5,431,578 A 7/1995 Wayne
5,435,876 A 7/1995 Alfaro et al.
5,457,342 A 10/1995 Herbst, II
5,458,426 A 10/1995 Ito
5,475,922 A 12/1995 Tamura et al.
5,478,244 A 12/1995 Maue et al.
5,490,040 A 2/1996 Gaudenzi et al.
5,503,565 A 4/1996 McCoy
5,511,987 A 4/1996 Shinchi
5,512,519 A 4/1996 Hwang
5,533,915 A 7/1996 Deans
5,549,480 A 8/1996 Cheng
5,558,542 A 9/1996 O' Sullivan et al.
5,564,952 A 10/1996 Davis et al.
5,577,928 A 11/1996 Duclos
5,582,519 A 12/1996 Buchter
5,588,859 A 12/1996 Maurice
5,590,463 A 1/1997 Feldman et al.
5,605,489 A 2/1997 Gale et al.
5,609,502 A 3/1997 Thumma
5,618,187 A 4/1997 Goto
5,622,511 A 4/1997 Jarrett
5,637,008 A 6/1997 Kozel
5,643,009 A 7/1997 Dinkel et al.
5,643,013 A 7/1997 Weidler et al.
5,664,968 A 9/1997 Micklevicz
5,664,973 A 9/1997 Emmert et al.
5,667,392 A 9/1997 Kocher et al.
5,691,041 A 11/1997 Frankeny et al.
5,702,255 A 12/1997 Murphy et al.
5,716,234 A 2/1998 Phillips
5,727,963 A 3/1998 LeMaster
5,730,609 A 3/1998 Harwath
5,741,144 A 4/1998 Elco et al.
5,741,161 A 4/1998 Cahaly et al.
5,742,484 A 4/1998 Gillette et al.
5,743,009 A 4/1998 Matsui et al.
5,745,349 A 4/1998 Lemke 5,746,608 A 5/1998 Taylor
5,749,746 A 5/1998 Tan et al.
5,755,595 A 5/1998 Davis et al.
5,772,451 A 6/1998 Dozier, II et al.
5,782,644 A 7/1998 Kiat
5,785,557 A 7/1998 Davis
5,787,971 A 8/1998 Dodson
5,795,191 A 8/1998 Preputnick et al.
5,810,607 A 9/1998 Shih et al.
5,817,973 A 10/1998 Elco et al.
5,823,798 A 10/1998 Zintler et al.
5,827,094 A 10/1998 Aizawa et al.
5,831,314 A 11/1998 Wen
5,857,857 A 1/1999 Fukuda
5,865,651 A 2/1999 Dague et al.
5,872,046 A 2/1999 Kaeriyama et al.
5,874,776 A 2/1999 Kresge et al.
5,876,219 A 3/1999 Taylor et al.
5,876,248 A 3/1999 Brunker et al.
5,882,214 A 3/1999 Hillbish et al.
5,882,231 A 3/1999 Takano et al.
5,883,782 A 3/1999 Thurston et al.
5,888,884 A 3/1999 Wojnarowski
5,904,594 A 5/1999 Longueville et al.
5,908,333 A 6/1999 Perino et al.
5,919,050 A 7/1999 Kehley et al.
5,923,995 A 7/1999 Kao et al.
5,924,899 A 7/1999 Paagman
5,930,114 A 7/1999 Kuzmin et al.
5,937,140 A 8/1999 Leonard et al.
5,955,888 A 9/1999 Frederickson et al.
5,961,355 A 10/1999 Morlion et al.
5,971,817 A 10/1999 Longueville
5,975,921 A 11/1999 Shuey
5,980,270 A 11/1999 Fjelstad et al.
5,980,321 A 11/1999 Cohen et al.
5,984,726 A 11/1999 Wu
5,993,259 A 11/1999 Stokoe et al.
6,012,948 A 1/2000 Wu
6,027,360 A 2/2000 Jenkins
6,036,549 A 3/2000 Wulff
6,041,498 A 3/2000 Hillbish et al.
6,050,862 A 4/2000 Ishii
6,059,170 A 5/2000 Jimarez et al.
6,062,911 A 5/2000 Davis et al.
6,063,696 A 5/2000 Brenner et al.
6,066,048 A 5/2000 Lees
6,068,520 A 5/2000 Winings et al.
6,071,141 A * 6/2000 Semmeling et al. ..... 439/353
6,071,152 A 6/2000 Achammer et al.
6,077,130 A 6/2000 Hughes et al.
6,089,878 A 7/2000 Meng
6,095,827 A 8/2000 Dutkowsky et al.
6,123,554 A 9/2000 Ortega et al.
6,125,535 A 10/2000 Chiou et al.
6,139,336 A 10/2000 Olson
6,146,157 A 11/2000 Lenoir et al.
6,146,202 A 11/2000 Ramey et al.
6,146,203 A 11/2000 Elco et al.
6,152,756 A 11/2000 Huang et al.
6,171,140 B1 1/2001 Anbo et al.
6,174,198 B1 1/2001 Wu et al.
6,178,106 B1 1/2001 Umemoto et al.
6,180,891 B1 1/2001 Murdeshwar
6,183,287 B1 2/2001 Po
6,183,301 B1 2/2001 Paagman
6,190,213 B1 2/2001 Reichart et al.
6,190,215 B1 2/2001 Pendleton et al.
6,193,537 B1 2/2001 Harper, Jr. et al.
6,196,871 B1 3/2001 Szu
6,202,916 B1 3/2001 Updike et al.
6,206,722 B1 3/2001 Ko et al.
6,210,197 B1 4/2001 Yu
6,210,240 B1 4/2001 Comerci et al.
6,212,755 B1 4/2001 Shimada et al.
6,215,180 B1 4/2001 Chen et al.
6,219,913 B1 4/2001 Uchiyama
6,220,884 B1 4/2001 Lin
6,220,895 B1 4/2001 Lin
6,220,896 B1 4/2001 Bertoncici et al.
6,234,851 B1 5/2001 Phillips
6,238,225 B1 5/2001 Middlehurst et al.
6,250,942 B1 6/2001 Lemke et al.
6,257,478 B1 7/2001 Straub
6,259,039 B1 7/2001 Chroneos, Jr. et al.
6,261,132 B1 7/2001 Koseki et al.
6,269,539 B1 8/2001 Takahashi et al.
6,274,474 B1 8/2001 Caletka et al.
6,280,230 B1 8/2001 Takase et al.
6,293,827 B1 9/2001 Stokoe et al.
6,299,492 B1 10/2001 Pierini et al.
6,309,245 B1 10/2001 Sweeney
6,312,277 B1 11/2001 Holub
6,319,075 B1 11/2001 Clark et al.
6,322,377 B2 11/2001 Middlehurst et al.
6,328,602 B1 12/2001 Yamasaki et al.
6,335,224 B1 1/2002 Peterson et al.
6,347,952 B1 2/2002 Hasegawa et al.
6,350,134 B1 2/2002 Fogg et al.
6,358,094 B1 3/2002 Belopolsky et al.
6,359,783 B1 3/2002 Noble
6,360,940 B1 3/2002 Bolde et al.
6,361,375 B1 3/2002 Sinclair
6,362,961 B1 3/2002 Chiou
6,363,607 B1 4/2002 Chen et al.
6,371,773 B1 4/2002 Crofoot et al.
6,379,188 B1 4/2002 Cohen et al.
6,386,924 B2 5/2002 Long
6,394,818 B1 5/2002 Smalley, Jr.
6,398,577 B1 * 6/2002 Simmel et al. ..... 439/357
6,402,566 B1 6/2002 Middlehurst et al.
6,409,543 B1 6/2002 Astbury, Jr. et al.
6,428,328 B2 8/2002 Haba et al.
6,431,914 B1 8/2002 Billman
6,435,914 B1 8/2002 Billman
6,450,829 B1 9/2002 Weisz-Margulescu
6,461,183 B1 10/2002 Ohkita et al.
6,461,202 B2 10/2002 Kline
6,471,523 B1 10/2002 Shuey
6,471,548 B2 10/2002 Bertoncini et al.
6,472,474 B2 10/2002 Burkhardt et al.
6,488,549 B1 12/2002 Weller et al.
6,489,567 B2 12/2002 Zachrai
6,506,081 B2 1/2003 Blanchfield et al.
6,514,103 B2 2/2003 Pape et al.
6,537,111 B2 3/2003 Brammer et al.
6,544,046 B1 4/2003 Hahn et al.
6,551,112 B1 4/2003 Li et al.
6,554,647 B1 4/2003 Cohen et al.
6,572,410 B1 6/2003 Volstorf et al.
6,575,774 B2 6/2003 Ling et al.
6,575,776 B1 6/2003 Conner et al.
6,585,536 B1 7/2003 Wu
6,592,381 B2 7/2003 Cohen et al.
6,604,967 B2 8/2003 Middlehurst et al.
6,629,854 B2 10/2003 Murakami
6,652,318 B1 11/2003 Winings et al.
6,663,426 B2 12/2003 Hasircoglu et al.
6,665,189 B1 12/2003 Lebo
6,669,514 B2 12/2003 Weibking et al.
6,672,884 B1 1/2004 Toh et al.
6,672,907 B2 1/2004 Azuma
6,679,709 B2 1/2004 Takeuchi
6,692,272 B2 2/2004 Lemke et al.
6,702,594 B2 3/2004 Lee et al.
6,705,902 B1 3/2004 Yi et al.
6,712,621 B2 3/2004 Li et al.
6,716,068 B2 4/2004 Wu
6,740,820 B2 5/2004 Cheng
6,743,037 B2 6/2004 Kassa et al.
6,746,278 B2 6/2004 Nelson et al.
6,769,883 B2 8/2004 Brid et al.
6,769,935 B2 8/2004 Stokoe et al.
6,776,635 B2 8/2004 Blanchfield et al.
6,776,649 B2 8/2004 Pape et al.
6,780,027 B2 8/2004 Allison et al.
6,790,088 B2 9/2004 Ono et al.
6,796,831 B1 9/2004 Yasufuku et al.

| | | | | |
|---|---|---|---|---|
| 6,810,783 | B1 | 11/2004 | Larose | |
| 6,811,440 | B1 | 11/2004 | Rothermel et al. | |
| 6,814,590 | B2 | 11/2004 | Minich et al. | |
| 6,829,143 | B2 | 12/2004 | Russell et al. | |
| 6,835,103 | B2 | 12/2004 | Middlehurst et al. | |
| 6,843,687 | B2 | 1/2005 | McGowan et al. | |
| 6,848,886 | B2 | 2/2005 | Schmaling et al. | |
| 6,848,950 | B2 | 2/2005 | Allison et al. | |
| 6,848,953 | B2 * | 2/2005 | Schell et al. | 439/825 |
| 6,869,294 | B2 | 3/2005 | Clark et al. | |
| 6,872,100 | B2 * | 3/2005 | Correll et al. | 439/752 |
| 6,884,117 | B2 | 4/2005 | Korsunsky et al. | |
| 6,890,221 | B2 | 5/2005 | Wagner | |
| D506,728 | S | 6/2005 | Tashiro | |
| 6,905,367 | B2 | 6/2005 | Crane, Jr. et al. | |
| 6,929,504 | B2 | 8/2005 | Ling et al. | |
| 6,947,012 | B2 | 9/2005 | Aisenbrey | |
| 6,975,511 | B1 | 12/2005 | Lebo et al. | |
| 6,994,569 | B2 | 2/2006 | Minich et al. | |
| 7,001,189 | B1 | 2/2006 | McGowan et al. | |
| D516,515 | S | 3/2006 | Shimizu et al. | |
| D517,014 | S | 3/2006 | Riku | |
| 7,059,892 | B1 | 6/2006 | Trout | |
| 7,059,919 | B2 | 6/2006 | Clark et al. | |
| 7,065,871 | B2 | 6/2006 | Minich et al. | |
| 7,070,464 | B2 | 7/2006 | Clark et al. | |
| 7,074,096 | B2 | 7/2006 | Copper et al. | |
| 7,086,147 | B2 | 8/2006 | Caletka et al. | |
| 7,097,465 | B1 | 8/2006 | Korsunsky et al. | |
| 7,101,228 | B2 | 9/2006 | Hammer et al. | |
| 7,104,812 | B1 | 9/2006 | Bogiel et al. | |
| 7,114,963 | B2 | 10/2006 | Shuey et al. | |
| RE39,380 | E | 11/2006 | Davis | |
| 7,134,900 | B2 * | 11/2006 | Chung | 439/353 |
| 7,137,848 | B1 | 11/2006 | Trout et al. | |
| 7,168,963 | B2 | 1/2007 | Minich et al. | |
| 7,182,642 | B2 | 2/2007 | Ngo et al. | |
| 7,204,699 | B2 | 4/2007 | Stoner | |
| D542,736 | S | 5/2007 | Riku | |
| 7,220,141 | B2 | 5/2007 | Daily et al. | |
| 7,258,562 | B2 | 8/2007 | Daily et al. | |
| 7,273,382 | B2 | 9/2007 | Igarashi et al. | |
| 7,303,427 | B2 | 12/2007 | Swain | |
| 7,335,043 | B2 | 2/2008 | Hgo et al. | |
| 7,384,289 | B2 | 6/2008 | Minich | |
| 7,402,064 | B2 | 7/2008 | Daily | |
| 7,425,145 | B2 | 9/2008 | Ngo et al. | |
| 7,452,249 | B2 | 11/2008 | Daily | |
| 7,458,839 | B2 | 12/2008 | Ngo | |
| 7,476,108 | B2 | 1/2009 | Swain | |
| 7,540,770 | B2 * | 6/2009 | Ishizuka et al. | 439/570 |
| 7,541,135 | B2 | 6/2009 | Swain | |
| 7,637,767 | B2 | 12/2009 | Davis et al. | |
| 7,641,500 | B2 | 1/2010 | Stoner et al. | |
| 7,654,852 | B2 | 2/2010 | Droesbeke et al. | |
| 2001/0003685 | A1 | 6/2001 | Aritani | |
| 2001/0049229 | A1 | 12/2001 | Pape et al. | |
| 2002/0106930 | A1 | 8/2002 | Pape et al. | |
| 2002/0142676 | A1 | 10/2002 | Hosaka et al. | |
| 2002/0159235 | A1 | 10/2002 | Miller et al. | |
| 2002/0193019 | A1 | 12/2002 | Blanchfield et al. | |
| 2003/0013330 | A1 | 1/2003 | Takeuchi | |
| 2003/0119378 | A1 | 6/2003 | Avery | |
| 2003/0143894 | A1 | 7/2003 | Kline et al. | |
| 2003/0219999 | A1 | 11/2003 | Minich et al. | |
| 2003/0220021 | A1 | 11/2003 | Whiteman, Jr. et al. | |
| 2003/0236035 | A1 | 12/2003 | Kuroda et al. | |
| 2004/0072471 | A1 * | 4/2004 | Wu | 439/638 |
| 2004/0121642 | A1 | 6/2004 | Jones et al. | |
| 2004/0147177 | A1 * | 7/2004 | Wagner | 439/855 |
| 2004/0183094 | A1 | 9/2004 | Caletka et al. | |
| 2004/0253879 | A1 * | 12/2004 | Correll et al. | 439/752 |
| 2004/0253880 | A1 * | 12/2004 | Correll et al. | 439/752 |
| 2005/0112952 | A1 | 5/2005 | Wang et al. | |
| 2006/0003620 | A1 | 1/2006 | Daily et al. | |
| 2006/0079119 | A1 | 4/2006 | Wu | |
| 2006/0128197 | A1 | 6/2006 | McGowan et al. | |
| 2006/0141849 | A1 | 6/2006 | Trout | |
| 2006/0228927 | A1 | 10/2006 | Daily | |
| 2006/0228948 | A1 | 10/2006 | Swain | |
| 2006/0281354 | A1 | 12/2006 | Ngo et al. | |
| 2007/0197063 | A1 | 8/2007 | Ngo | |
| 2007/0202748 | A1 | 8/2007 | Daily | |
| 2007/0275586 | A1 | 11/2007 | Ngo | |
| 2007/0293084 | A1 | 12/2007 | Ngo | |
| 2008/0038956 | A1 | 2/2008 | Swain | |
| 2008/0248670 | A1 | 10/2008 | Daily et al. | |
| 2008/0305682 | A1 | 12/2008 | Wu | |

FOREIGN PATENT DOCUMENTS

| | | |
|---|---|---|
| DE | 2350834 | 4/1975 |
| DE | 3441416 | 11/1984 |
| DE | 8714071 | 12/1987 |
| DE | 4001104 | 1/1991 |
| DE | 10226279 | 11/2003 |
| EP | 0273683 | 7/1988 |
| EP | 0465013 | 1/1992 |
| EP | 0321257 | 4/1993 |
| EP | 0623248 | 11/1995 |
| EP | 0724 313 | 7/1996 |
| EP | 0789422 | 8/1997 |
| EP | 0951102 | 10/1999 |
| EP | 1091449 | 9/2004 |
| FR | 2699744 | 6/1994 |
| GB | 1162705 | 8/1969 |
| GB | 2168550 | 6/1986 |
| JP | 05-344728 | 12/1993 |
| JP | 6068943 | 3/1994 |
| JP | 06-236788 | 8/1994 |
| JP | 07-114958 | 5/1995 |
| JP | 07-169523 | 7/1995 |
| JP | 08-096918 | 4/1996 |
| JP | 08-125379 | 5/1996 |
| JP | 09-055245 | 2/1997 |
| JP | 9199215 | 7/1997 |
| JP | 2000-003743 | 1/2000 |
| JP | 2000-003744 | 1/2000 |
| JP | 2000-003745 | 1/2000 |
| JP | 2000-003746 | 1/2000 |
| JP | 2000-228243 | 8/2000 |
| JP | 13135388 | 5/2001 |
| JP | 2003-217785 | 7/2003 |
| KR | 100517651 | 9/2005 |
| TW | 576555 | 8/1990 |
| TW | 546872 | 8/2003 |
| WO | WO 97/43885 | 11/1997 |
| WO | WO 97/44859 | 11/1997 |
| WO | WO 97/47058 | 12/1997 |
| WO | WO 98/15989 | 4/1998 |
| WO | WO 00/16445 | 3/2000 |
| WO | WO 01/29931 | 4/2001 |
| WO | WO 01/39332 | 5/2001 |
| WO | WO 02/103847 | 12/2002 |
| WO | WO 2005/065254 | 7/2005 |
| WO | WO 2007/064632 | 6/2007 |
| WO | WO 2008/117180 | 10/2008 |

OTHER PUBLICATIONS

U.S. Appl. No. 12/317,366, filed Dec. 22, 2008, Minich.

FCI, "PWRBlade Power Distribution Connector System", 2003, www.fciconnect.com, 2 pages.

FCI, "PWRBlade Power Distribution Connector System", Technology Innovation Service, 2003, 2-3.

FCI, "PWRBlade, new Power Distribution connector for electronic applications," Product News, 2003, www.fciconnect.com, 1 page.

FCI, "Act Connectors in Action", Panorama, 2003, 1 page.

FCI, "PWRBlade PM 24S+6P C&A" Drawing No. 10080591-HAB0023LF: Sep. 24, 2008, 2 pages.

FCI, "PWRBLD 2P .3" Drawing No. 10080594-1AD0078LF: Oct. 8, 2008, 2 pages.

Finan, J.M., "Thermally Conductive Thermoplastics", LNP Engineering Plastics, Inc., Plastics Engineering 2000, www.4spe.org, 4 pages.

Metral 1000 Series, PCB Mounted Receptacle Assembly, FCI Web Site page, 2001, 1 p.
Ogando, J., "And now—An Injection-Molded Heat Exchanger", Sure, plastics are thermal insulators, but additive packages allow them to conduct heat instead, Global Design News, Nov. 1, 2000, 4 pages.
Power TwinBlade™ I/O Cable Connector RA-North-South, No. GS-20_072, Aug. 6, 2007, 11 pages.
Product Datasheets, 10 Bgit/s XENPAK 850 nm Transponder (TRP1OGVP2045), Copyright 2005, MergeOptics GmbH, 13 pages.
Product Datasheets, Welome to XENPAK.org., Copyright 2001, http://www.xenpak.org., 1 page.
Sherman, L.M., "Plastics that Conduct Heat", Plastics Technology Online, Jun. 2001, http://www.plasticstechnology.com, 4 pages.

* cited by examiner 369
379
365
377
336
74
72
332
357
377
369
379
290
280
236
74
72
232
290
280
98
90
82
80
84
74
36
72
32
98
90
145
74
136
72
132

ELECTRICAL CONNECTOR HAVING POWER CONTACTS

CROSS REFERENCE TO RELATED APPLICATIONS

This application claims the benefit of U.S. provisional patent application Ser. No. 61/148,646 filed on Jan. 30, 2009, the disclosure of which is hereby incorporated by reference as if set forth in its entirety herein.

BACKGROUND

The present disclosure relates generally to electrical connectors, and more specifically relates to an electrical connector for transmitting electrical power, for instance to a printed circuit board.

Electrical power connectors are well known, and include housings that carry electrical power contacts, and can additionally carry electrical signal and/or ground contacts. The electrical contacts define opposing mating ends and mounting ends that define a mating interface and mounting interface, respectively, of the electrical connector. The mating ends of the electrical contacts are configured to connect with corresponding mating ends of electrical contacts of a complementary electrical connector. In the case of electrical power connectors, the mounting ends of the power contacts are connected to a power source, such as electrical power cables, while the mounting ends of the complementary electrical power contacts are connected to a device that receives power, such as a printed circuit board or other electrical device. The connectors can be provided as header connectors and receptacle connectors that are configured to mate with each other at their respective mating interfaces.

Referring to FIG. 1, a conventional power connector 20 includes a housing 22 in the form of a clamshell having a first portion 22*a* and a second portion 22*b* that, when connected, define a mounting interface 24 that receives a plurality of power cables 26, and a mating interface 28 configured to mate with a complementary electrical connector to supply power to an electrical component, such as a printed circuit board. The connector 20 can further includes signal pins 29 as illustrated that are configured to connect with an electrical signal cable 30. Due to the size constraints of the mating interface of the complementary connector, the power connector 20 is arranged so that the power cables 26 are vertically staggered, thereby increasing the height of the power connector 20. The clamshell housing 22 is thus configured such that the mating interface 28 has a height sufficient for the housing 22 to mate with the complementary connector, while the mating interface 24 has a height sufficient to accommodate the power cables 26. Of course, it should be appreciated that FIG. 1 illustrates one type of electrical connector, and that numerous other power connectors are known in the art.

What is desired is an electrical power connector that is simplified with respect to conventional electrical power connectors.

SUMMARY

In accordance with one embodiment, an electrical power connector is provided that is configured to mate with a complementary electrical connector. The electrical power connector includes a connector housing extending between opposing side walls so as to define a contact-retaining void. The electrical power connector further includes a plurality of electrical signal contacts retained in the contact-retaining void, and a plurality of electrical power contacts retained in the contact-retaining void. The electrical signal and power contacts define respective mating ends configured to mate with complementary signal and power contacts of the complementary electrical connector, and the electrical power contacts define respective linearly aligned mounting ends configured to couple to respective electrical cable conductors. The electrical power connector further includes an engagement assembly carried by the housing. The engagement assembly includes 1) at least one asymmetrically positioned polarization pocket carried by at least one of the side walls and configured to receive a polarization member of the complementary electrical connector only when the electrical power connector is in a desired orientation relative to the complementary electrical connector, and 2) a latch carried by the at least one of the side walls, the latch configured to releasably engage a securement member of the complementary electrical connector.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show embodiments that are presently preferred. The invention is not limited, however, to the specific instrumentalities disclosed in the drawings.

DETAILED DESCRIPTION

Figure 1:
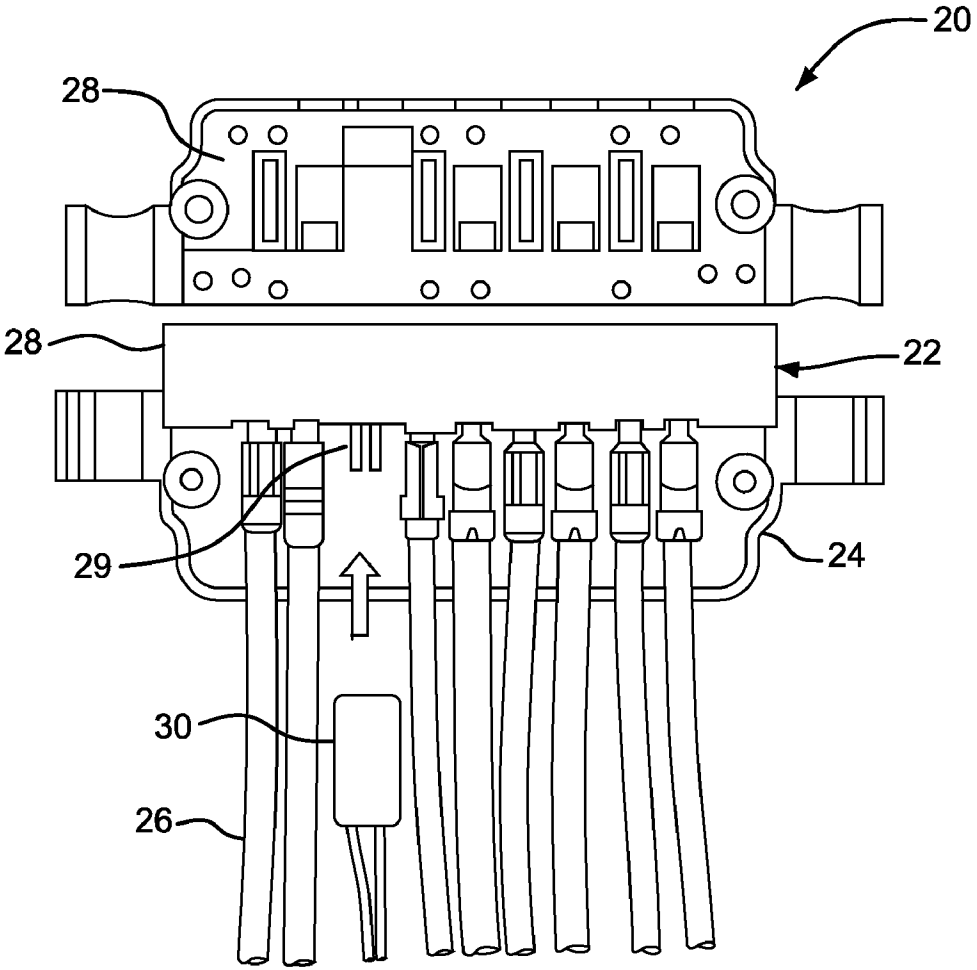
FIG. 1 (Prior Art)
FIG. 1 is a top view of an electrical power connector constructed in accordance with the prior art.
Figure 2A:
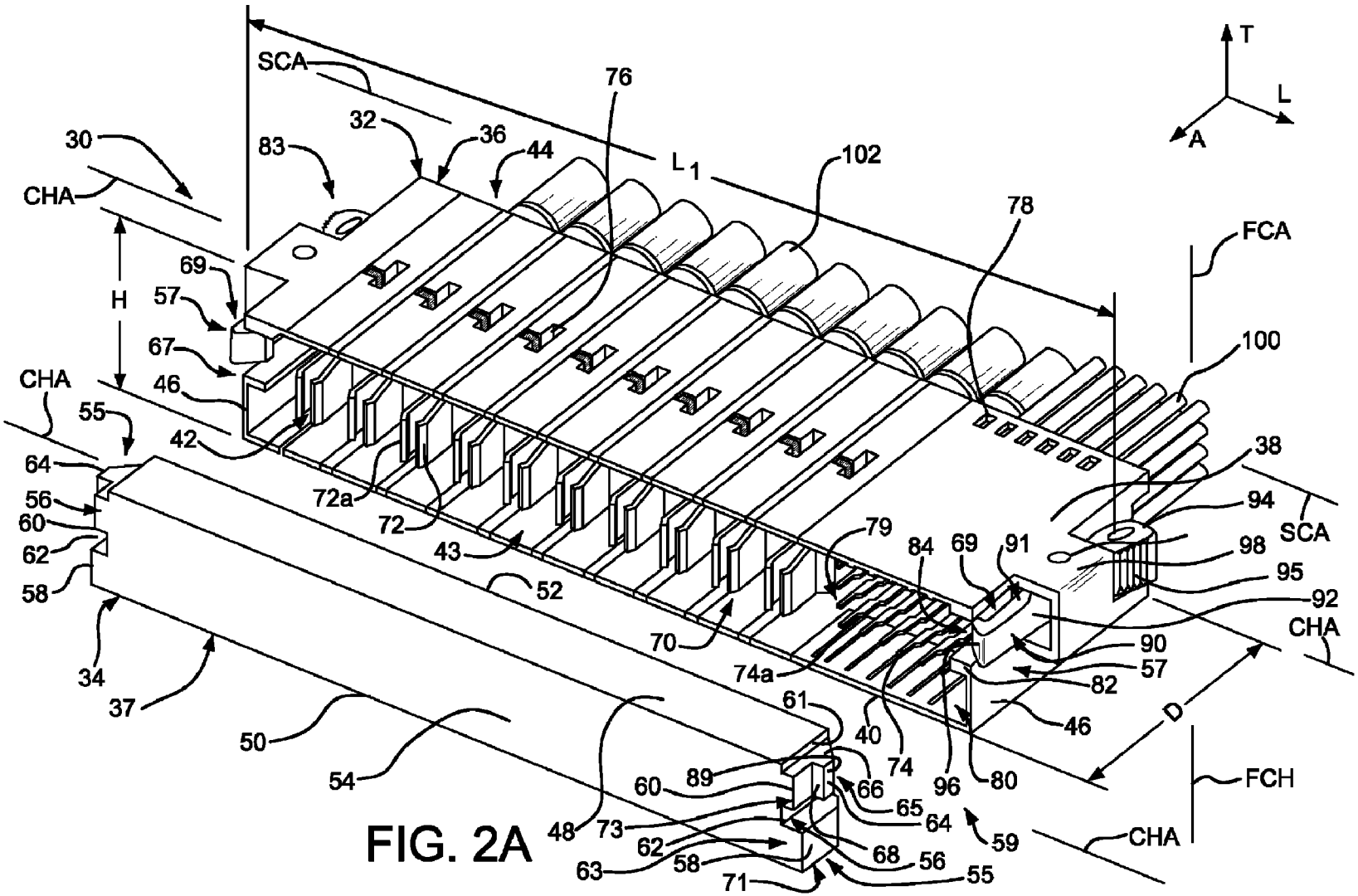
FIG. 2A is a perspective view of an electrical power connector assembly including a electrical power header connector and a schematically illustrated complementary electrical power receptacle connector constructed in accordance with one embodiment, showing the header connector electrically connected to a plurality of electrical power cables and electrical signal cables.

Referring to FIG. 2A, an electrical connector assembly 30 constructed in accordance with one embodiment includes a first electrical power connector in the form of a power header connector 32 configured to mate with a second electrical connector in the form of a right-angle power receptacle connector 34. The header connector 32 includes a dielectric connector housing 36. The connector housing 36 further defines at least one polarization pocket 80 at a mating interface 43 of the connector housing 36. The connector housing 36 further defines a top wall 38 and an opposed bottom wall 40, a front end 42 and an opposed rear end 44, and opposed first and second side walls 46. The connector housing 36 extends along a connector housing axis CHA that extends between the opposed side walls 46 so as to define a contact-retaining void 70 that is disposed between the side walls 46, and thus at least partially defined by the side walls 46 and the top wall 38. The front end 42 defines a mating interface 43 of the electrical connector housing 32, and the rear end 44 defines a mounting interface 45 of the electrical connector 32. Because the mating interface 43 and the mounting interface 45 are parallel to each other, the power header connector 32 is configured as a vertical electrical power connector.

The receptacle connector 34 includes a dielectric connector housing 37 that defines a top wall 48 and an opposing bottom end 50, a front end 52 and an opposing rear wall 54, which defines a contact-receiving void 70 (similar to the header connector shown in FIG. 4C except with receptacle contacts having two spaced apart contact walls) with the opposing side walls 56. The front end 52 defines a mating interface 53 of the electrical connector 34, and the bottom end 50 defines a mounting interface 51 of the electrical connector 34. Because the mating interface 53 and the mounting interface 51 are perpendicular to each other, the power receptacle connector 34 is configured as a right-angle electrical power connector. One or both side walls 56 may define a latch engagement member such, as a latch ear 64, that may be spaced from the top wall 48 of the connector housing 37. Another of the opposed side walls 56 may define a polarization member, such as a protrusion (cut-out or solid), that is spaced farther from the top wall 48 than the latch engagement member or latch ear 64. In one embodiment, the polarization member does not receive a complementary polarization member, but rather is configured to be received in a complementary polarization member.

The top and bottom walls 38 and 40 of the header connector 32 extend in a plane defined by a longitudinal direction L and a lateral direction A. The housing 36 is elongate along the longitudinal direction L, which defines a length L1 of the connector 32, and the lateral direction A defines a depth D of the connector 32. The connector 32 further defines a height H that extends along a transverse direction T that extends perpendicular to the longitudinal and lateral directions. The top wall and bottom end 48 and 50 of the receptacle connector 34 likewise extend in a plane defined by the longitudinal direction L and a lateral direction A. The housing 37 is elongate along the longitudinal direction.

It will thus be appreciated that various structure is described herein as extending horizontally along the longitudinal direction "L" and lateral direction "A", and vertically along a transverse direction "T". Unless otherwise specified herein, the terms "lateral," "longitudinal," and "transverse" are used to describe the orthogonal directional components of various components. The terms "inboard" and "inner," and "outboard" and "outer" with respect to a specified directional component are used herein with respect to a given apparatus to refer to directions along the directional component toward and away from the center apparatus, respectively. The terms "forward" or "front" are used to describe a direction toward the front end of a connector, while the terms "rearward" or "rear" are used to describe a direction toward the rear end of a connector.

It should be appreciated that while the longitudinal and lateral directions are illustrated as extending along a horizontal plane, and that the transverse direction is illustrated as extending along a vertical plane, the planes that encompass the various directions may differ during use, depending, for instance, on the desired orientation of the electrical connector. Accordingly, the terms "vertical" and "horizontal" are used to describe the connector assembly 30 and associated electrical connectors and components as illustrated for the purposes of clarity, it being appreciated that these orientations may change during use.

The receptacle connector housing 37 retains a plurality of electrical receptacle power contacts (not shown) having mating ends configured to receive respective electrical header power contacts of a complementary header connector, such as the header connector 32, and can further retains a plurality of electrical receptacle signal contacts (not shown) having mating ends configured to receive respective electrical header signal contacts of the complementary header connector. The receptacle power and signal contacts further define mounting ends configured to attach to an external electrical device, such as a printed circuit board. The mounting ends can extend through the bottom end 50 at an angle perpendicular to the mating ends such that the connector 34 is configured as a right-angle connector as illustrated. Alternatively, the mounting ends can extend through the rear wall 54 if desired, such that the connector 34 is configured as a vertical connector.

The connector assembly 30 includes an engagement system 59 that is configured to ensure that the connectors 32 and 34 are securely mated in a predetermined orientation, such that the power contacts mate with complementary power contacts, and the signal contacts mate with complementary signal contacts. The engagement system 59 includes a first pair of engagement assemblies 55 of the receptacle connector 34, and a second pair of engagement assemblies 57 of the header connector 34 that is configured to interface with the first engagement assembly 55. Each engagement assembly 55 is carried by the receptacle connector housing 37, and in particular is carried by at least one of the opposing side walls 56, and each of the opposing side walls 56 in the illustrated embodiment. Likewise, each engagement assembly 57 of the electrical header connector 32 is carried by the header connector housing 36, and in particular is carried by at least one of the opposing side walls 46, and each of the opposing side walls 46 in the illustrated embodiment. Thus, while the engagement assemblies 55 and 57 are described below with respect to one of the side walls, it should be appreciated that the engagement assemblies 55 and 57 can also be disposed on the opposing side wall as illustrated.

Each engagement assembly 55 of the receptacle connector 34 includes a polarization assembly 63 and a securement assembly 65, and the engagement assembly 57 of the header connector 32 includes a complementary polarization assembly 67 and a securement assembly 69. The polarization assemblies 63 and 67 engage to ensure that the connectors 32 and 34 engage each other in their proper relative orientations, and the securement assemblies 65 and 69 secure the connectors 32 and 34 in their mated configuration.

The polarization assembly 63 includes a first polarization member 71 in the form of a lower polarization guide wall 58 that projects longitudinally out from at least one of the side walls 56, and each side wall 56 as illustrated, and a second polarization member 73 in the form of an upper polarization guide wall 60 projecting longitudinally out from at least one of the side walls 56, and each side wall 56 as illustrated, at a location above the lower polarization guide wall 58. The polarization guide walls 58 and 60 are vertically aligned as illustrated, but could be vertically offset in an alternative embodiment. The lower and upper polarization guide walls 58 and 60 are both illustrated as projections that are rectangular in shape, and horizontally oriented, but can assume any geometrical configuration as desired. The lower polarization guide wall 58 extends the entire depth of the side wall 56, however the lower polarization guide wall 58 can alternatively define any lateral length as desired.

The upper polarization guide wall 60 is disposed above the lower polarization guide wall 58 so as to define a gap 62 disposed vertically between the upper polarization guide wall 60 and lower polarization guide wall 58. The polarization guide walls 58 and 60 are each positioned vertically asymmetrically, such that the gap 62 is vertically offset with respect to a vertical midpoint of the side wall 56. In accordance with the illustrated embodiment, the polarization guide walls 58 and 60 are differently shaped such that the lower polarization guide wall 58 has a height that is greater than the upper polarization guide wall 60. The asymmetry of the polarization assembly ensures that a complementary electrical connector having a corresponding polarization assembly is mated to the electrical connector 34 in a desired orientation. It should be appreciated that the polarization assembly 63 can alternatively be constructed asymmetrically with respect to any direction as desired. The upper polarization guide wall 60 extends the entire depth of the side wall 56, however the upper polarization guide wall 60 can alternatively define any lateral length as desired. The upper polarization guide wall 60 is disposed vertically below the top surface 48 so as to define a notch 61 defined at its lower end by the upper polarization guide wall 60, and at one side by the portion of the side wall 56 extending between the upper polarization guide wall 60 and the upper surface 48.

With continuing reference to FIG. 2A, the securement assembly 65 includes a securement member 89 illustrated as a latch ear 64 that projects longitudinally out from at least one of the upper polarization guide walls 58 and 60, and both of the upper polarization guide walls 60 as illustrated. Thus, the latch ear 64 also projects longitudinally out from the side wall 56. While the latch ear 64 projects out from the upper polarization guide wall 60 as illustrated, it should be appreciated that the latch could alternatively project out from any location of the housing 37 or the respective side wall 56, such as the lower polarization guide wall 58. Each latch ear 64 presents a cam surface 66 that extends longitudinally outward along a rearward direction and terminates at its rear end at a rear catch surface 68 that extends longitudinally between the upper polarization guide wall 60 and the rear end of the cam surface 66. The cam surface 66 is illustrated as straight, but can alternatively be curved or define any other shape as desired, such that the latch ear 64 is configured to engage a corresponding latch of the complementary header connector 32, as is described in more detail below.

Referring now to FIGS. 2A-B, 4A, and 5A, the header connector 32 includes a plurality of electrical header power contacts 72 and a plurality of electrical header signal contacts 74 that are supported in the connector housing 36. In particular, the housing 36 defines an internal contact-retaining void 70 that retains the electrical contacts 72 and 74. While the signal contacts 74 are illustrated as being disposed between the power contacts 72 and one of the side walls 46, it should be appreciated that the signal contacts 74 could alternatively be disposed anywhere along the housing 36, such as between the power contacts 72 and the other side wall 46, or centrally disposed in the housing 32 such that power contacts 72 are disposed on either longitudinal sides of the signal contacts 74. The housing 36 includes a first plurality of retention apertures 76 extending vertically through the upper wall 38 that assist in the retention of the power contacts 72 in the housing 36, and a second plurality of retention apertures 78, extending through the upper wall and lower walls 38 and 40, that assist in the retention of the signal contacts 74 in the housing 36. In accordance with an alternative embodiment, the connector 36 is devoid of signal contacts, and only includes electrical power contacts 72.

The electrical power contacts 72 define a mating end 72*a* and an opposing mounting end 72*b* that extends parallel to the mating end 72*a*, such that the electrical power contacts 72 are configured as vertical contacts. It should be appreciated that the mounting ends 72*b* could alternatively be extend in a direction perpendicular with respect to the mating ends 72*a* such that the electrical power contacts 72 are configured as right-angle contacts. The mating ends 72*a* are disposed proximate to the mating interface 43 of the connector housing 36, while the mounting ends 72*b* are disposed proximate to the mounting interface 45 of the connector housing 36. The mating ends 72*a* of the power contacts 72 are configured to electrically mate with complementary electrical power contacts of the receptacle connector 34, and the mounting ends 72*a* of the power contacts 72 are configured to electrically mate with electrical power conductors provided as electrical cable conductors 102.

Figure 3E:
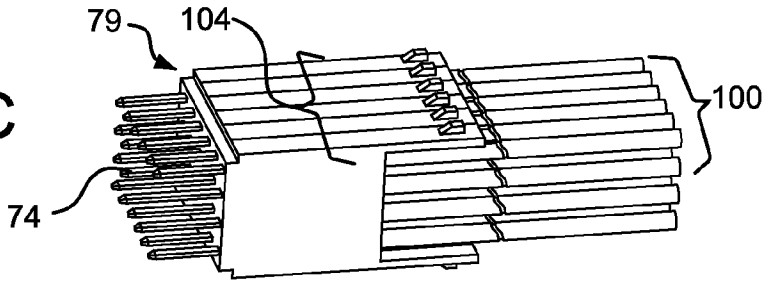
FIG. 3E is a perspective view of a plurality of adjacent vertical columns of signal contacts of the type illustrated in FIG. 3C.
Figure 3C:
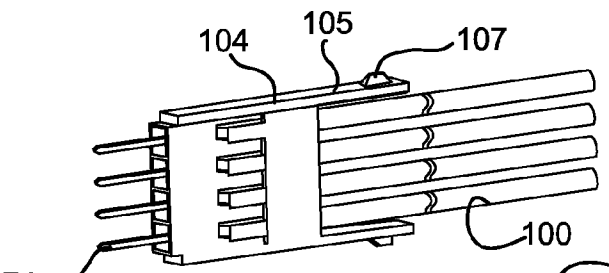
FIG. 3C is a perspective view of a plurality of electrical signal contacts of the header connector illustrated in FIG. 2 arranged in a vertical column, showing the signal contacts coupled to corresponding electrical signal cables.
Figure 3D:
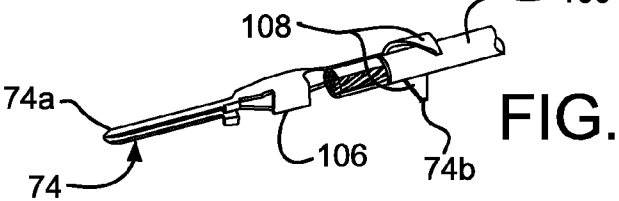
FIG. 3D is a perspective view of one of the electrical signal contacts illustrated in FIG. 3C, showing the connection of the signal contact to a corresponding electrical signal cable.
Figure 3F:
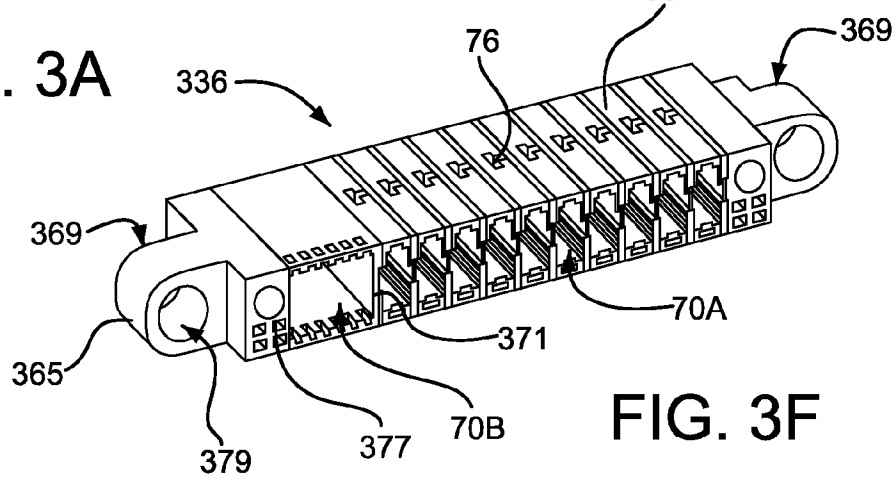
FIG. 3F is a perspective view of a connector housing similar to that illustrated in FIG. 2, but with mating features constructed in accordance with an alternative embodiment.
Figure 3A:
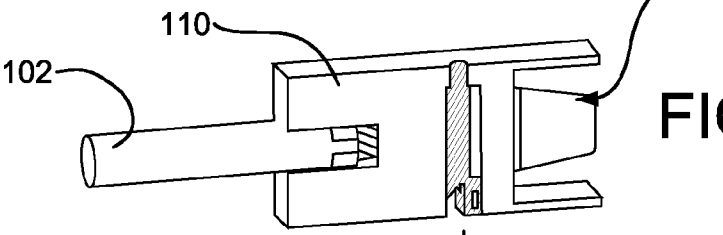
FIG. 3A is a perspective view of an electrical power contact of the electrical connector illustrated in FIG. 2 coupled to an electrical power cable.
Figure 3B:
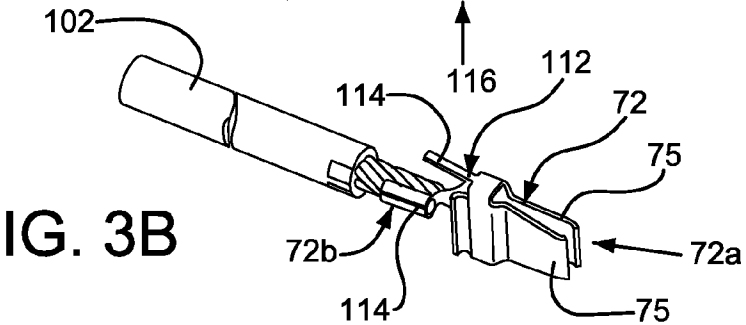
FIG. 3B is a perspective view showing the electrical power contact illustrated in FIG. 3A being coupled to the electrical power cable.

Referring now also to FIGS. 3A-B in particular, the power contacts 72 are each mounted in a dielectric power contact clip 110 such that the power contacts 72 are arranged as a pair of vertical blades 75 spaced longitudinally from each other so as to be received in the complementary electrical power receptacle contacts of the receptacle connector 34. While the power contacts 72 are illustrated as being configured as header contacts, the power contacts 72 could alternatively be provided as receptacle contacts if desired. Each power contact 72 includes a crimp sleeve 112 at its mounting end 72*b* that is further electrically connected to the cable 102. The crimp sleeve 112 includes flexible arms 114 that are crimped over the cable conductor 102 so as to place the mating end of the power contact 72 in electrical communication with the respective cable conductor 102. Accordingly, when the mating end of the power contacts 72 engages the mating end of the power contacts of the mating connector 34, the electrical power is transferred from the cable conductors 102, through the electrical power contacts 72 and the complementary electrical power contacts of the receptacle connector 34, and to the electronic device to which the connector 34 is mounted.

The connector 32 includes a locking member 116 that retains the power contacts 72 in the corresponding power contact clips 110, and can further extend into the retention aperture 76 formed in the upper wall 38 of the housing 36 so as to retain the power contact clip 110 in the housing 36. It should be appreciated, however, that any suitable engagement member can be provided that secures the power contacts in the corresponding clips 110, and secures the clips 110 in the connector housing 36. Alternatively still, the electrical power contacts 72 can be insert molded in the power contact clip 110. While the electrical power contacts 72 have been illustrated and described in accordance with one embodiment, it should be appreciated that the electrical connector 32 could include electrical power contacts constructed in accordance with any suitable alternative embodiment.

While the connector 32 is illustrated as including ten electrical power contacts 72 that are configured to electrically connect to ten corresponding cables conductors 102, it should be appreciated that any number of power contacts 72 and cables 102 can be provided, for instance between eight and fourteen, less than eight, and greater than fourteen. Furthermore, power cables 102 of various gauges can be installed in the connector 32 as desired.

It should be appreciated that the mounting ends 72*b* of each electrical power contact 72 are disposed at the same height on the connector housing 36, such that the mounting ends 72*b* are all longitudinally linearly aligned along the length of the connector housing 36. As a result, each cable conductor 102 extending into the housing 36 and electrically connected to a complementary mounting end 72*b* are also in longitudinal alignment along the length of the connector housing 36, thereby reducing the height of the connector 32 with respect to conventional power cable connectors configured to connect to vertically staggered cable conductors 102.

The connector housing 36 can thus define any suitable height H as desired, and has a height of approximately 15 mm in accordance with one embodiment. The connector housing 36 can define any length L as desired, and defines a length of approximately 100 mm in accordance with one embodiment. The connector housing 36 can define any depth D as desired, and has a depth of approximately 30 mm in accordance with one embodiment. It should be appreciated that these dimensions are provided by way of example only, and the various embodiments described herein are not intended to be limited to these dimensions, unless otherwise specified. The dimensions illustrated herein show that an electrical connector of the type described in connection with the illustrated embodiments are capable of achieving a reduced footprint with respect to conventional power cable connectors having staggered power cables.

Referring now to FIGS. 3C-E, the electrical signal contacts 74 define a mating end 74*a* and an opposing mounting end 74*b* that extends parallel to the mating end 74*a*, such that the electrical signal contacts 74 are configured as vertical contacts. It should be appreciated that the mounting ends 74*b* could alternatively be extend in a direction perpendicular with respect to the mating ends 74*a* such that the electrical signal contacts 74 are configured as right-angle contacts. The mating ends 74*a* are disposed proximate to the mating interface 43 of the connector housing 36, while the mounting ends 74*b* are disposed proximate to the mounting interface 45 of the connector housing 36. The mating ends 74*a* of the signal contacts 72 are configured to electrically mate with complementary electrical signal contacts of the receptacle connector 34, and the mounting ends 42*a* of the power contacts 74 are configured to electrically mate with electrical power conductors provided as electrical cable conductors 102. As shown in FIG. 2A, electrical cable conductors 100 attached to the linearly aligned mounting ends 74*b* of the plurality of electrical signal contacts 74 are aligned along a transverse first common axis FCA that is oriented perpendicular to a longitudinal connector housing axis CHA that passes through the side walls 46 and 56. The electrical cable conductors 102 connected to the linearly aligned mounting ends 72*b* of the electrical power contacts 74 are aligned along a transverse second common axis SCA that is parallel to the connector housing axis CHA and perpendicular to the first common axis FCA.

The electrical signal contacts 74 are configured in an array 79 and are configured to electrically connect to a complementary electrically conductive signal cable 1000. The array 79 of signal contacts includes a plurality of dielectric signal contact clips 104 disposed longitudinally adjacent each other. Each contact clip 104 includes a plurality of vertically spaced signal contacts 74 arranged along a vertical column. The signal contacts 74 can be insert molded in the corresponding contact clip 104, or otherwise installed in a clip as desired. While four signal contacts 74 are disposed in each clip 104 in accordance with the illustrated embodiment, it should be appreciated that each clip 104 can alternatively retain any number of signal contacts in any desired orientation.

Each signal contact 74 is electrically connected to an electrically conductive signal cable crimp sleeve 106 that is further electrically connected to the cable 100. The crimp sleeve 106 includes flexible arms 108 that crimp over the cable conductor so as to mechanically connect the signal contact 74 and the respective cable 100, and place the mating end of the signal contact 74 in electrical communication with the respective cable 100. Accordingly, when the mating end 74*a* of the signal contacts 74 engages the mating end of the signal contacts of the complementary receptacle connector 34, the electrical signal is transferred from the cables 100, through the electrical signal contacts 72 and the complementary electrical signal contacts of the receptacle connector 34, and to the electronic device to which the connector 34 is mounted. Each clip 104 has flexible arms 105 with projections 107 that interlock with the retention apertures 78 that extend through the top and bottom walls 38 and 40 of the housing 36. Any desired number of contact clips may be installed in the housing 36, such as six, which collectively retain twenty-four signal contacts 74 in the array 79.

Figure 2B:
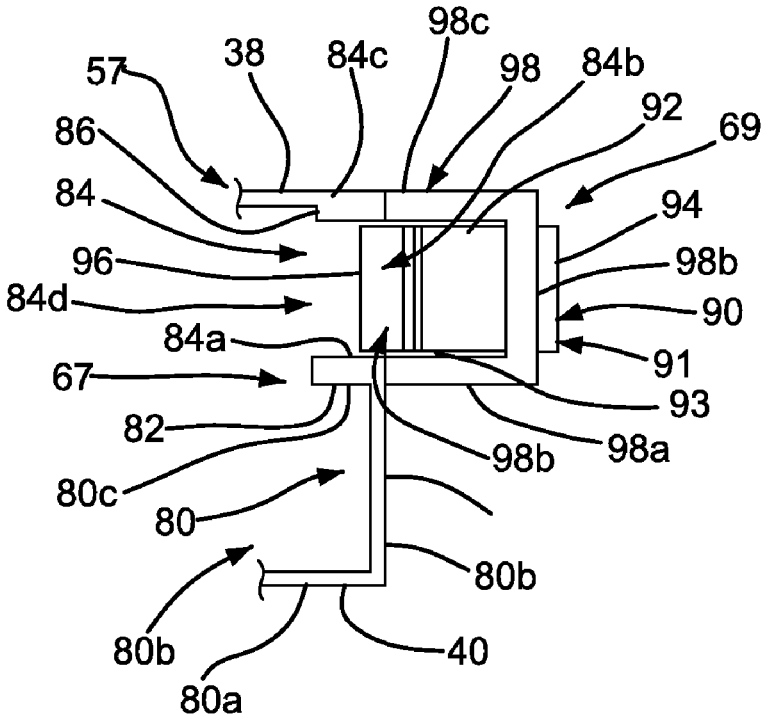
FIG. 2B is an enlarged front elevation of an engagement assembly of the electrical power header connector illustrated in FIG. 2A.

Referring now to FIGS. 2A-B, each engagement assembly 57 of the header connector 32 includes a polarization assembly 67 and a securement assembly 69 configured to interface with the polarization assembly 63 and the securement assembly 65 of the complementary receptacle connector 34. In accordance with the illustrated embodiment, the polarization assembly 63 includes a first polarization member 83 in the form of a lower polarization pocket 80 carried by, or formed in, at least one of the side walls 46, and each side wall 46 as illustrated, and a second polarization member 85 in the form of an upper polarization pocket 84 carried by, or formed in, at least one of the side walls 46, and each side wall 46 as illustrated. The lower pocket 80 is sized and configured to receive the corresponding lower polarization guide wall 58 of the complementary receptacle connector 34, and the upper pocket 84 is sized and configured to receive the corresponding upper polarization guide wall 60 of the complementary receptacle connector 34.

The lower pocket 80 defines a longitudinal boundary of the contact-retaining void 70, and includes a transverse lower pocket wall 80*a*, a longitudinally outer pocket side wall 80*b*, and a transverse upper pocket wall 80*c* that extends parallel to the lower pocket wall 80*a*. The longitudinally outer pocket side wall 80*b* extends between the lower and upper pocket walls 80*a* and 80*c*. In accordance with the illustrated embodiment, the lower pocket wall 80*a* is defined by the bottom wall 40 of the housing 36, the longitudinal outer wall 80*b* is defined by the side wall 46 of the housing 36, and the upper wall 80*c* is defined by the divider wall 82. Thus, the lower pocket 80 is rectangular in shape, and has a height defined by the transverse distance between lower and upper pocket walls 80*a* and 80*c* sized substantially equal to or slightly greater than the height of the lower polarization guide wall 58.

The longitudinally opposing pockets 80 of the connector housing 36 define a longitudinal distance between the opposing side walls 80*b* substantially equal to or slightly greater than the distance between the longitudinal outer surfaces of the corresponding lower polarization guide walls 58. Accordingly, the lower polarization guide wall 58 can be inserted into the lower pocket 80. The lower pocket 80 defines an inner longitudinal end 80*d* that is open to the contact-retaining void 70. While the lower pocket 80 is illustrated as generally rectangular, it should be appreciated that the lower pocket 80 can define any alternative geometric size and shape suitable to receive the lower polarization guide wall 58.

The upper pocket 84 includes a transverse lower pocket wall 84*a* and an opposing transverse upper pocket wall 84*c* that extends parallel to the lower pocket wall 84*a*. The lower pocket wall 84*a* is defined by the divider wall 82, and the upper pocket wall 84*c* is defined by the upper wall 38 of the housing 36. The pocket 84 includes an open longitudinally outer end 84*b* extending between the lower and upper and lower walls 84*a* and 84*c*, and an open longitudinally inner end 84*d* extending between the lower and upper and lower walls 84*a* and 84*c*. The longitudinally inner end 84*d* is open to the contact-retaining void 70, and the longitudinally outer end 84*b* is open to the securement assembly 69.

The upper pocket wall 84*c* has a vertical thickness, or height, that is greater than the upper wall 38 of the housing, and in particular extends transversely down with respect to the upper wall 38. The upper pocket wall 84*c* has a height that is substantially equal to or slightly less than the height of the notch 61, such that the upper pocket wall 84*c* is configured to be received in the notch 61 when the polarization assemblies 63 and 67 engage. Furthermore, the upper pocket 84 has a height defined by the transverse distance between the lower and upper pocket walls 84*a* and 84*c* sized substantially equal to or slightly greater than the height of the upper polarization guide wall 60, such that the upper polarization guide wall 60 can be inserted into the upper pocket 84 when the polarization assemblies 63 and 67 engage. It should be appreciated that the upper pocket 84 can define any geometric size and shape suitable to receive the upper polarization guide wall 60.

The divider wall 82 thus defines both the upper end of the lower pocket 80 and the lower end of the upper pocket 84. The pockets 80 and 84 are positioned vertically asymmetrically, such that the divider wall 82 is vertically offset with respect to a vertical midpoint of the side wall 46. That is, each pocket 80 and 84 are offset with respect to the vertical midpoint of the housing 36 or side wall 46. In accordance with the illustrated embodiment, the pockets 80 and 84 are differently shaped, and in particular have different heights, with the lower pocket 80 having a height that is greater than the upper pocket 84. The divider wall 82 is sized slightly smaller than the complementary gap 62 disposed between the polarization guide walls 58 and 60, and is further vertically positioned to be received in the complementary gap 62 when the polarization assemblies 63 and 67 engage. It should be appreciated that the polarization assembly 67 can alternatively be constructed asymmetrically with respect to any direction as desired, so as engage the complementary polarization assembly 63.

It should be appreciated that the polarization assemblies 63 and 67 therefore each include at least one asymmetrically positioned polarization member configured to engage only when each electrical connector 32 and 34 is in its desired orientation relative to the other connector. The at least one asymmetrically positioned polarization member of the polarization assembly 63 can be a wall provided by one or both polarization guide walls 58 and 60, or a recess provided by the gap 62. The at least one asymmetrically positioned polarization member of the polarization assembly 67 can be a wall provided by one or both of the divider walls 82 and the upper wall 84*c* of the upper pocket 84, or a recess provided by one or both pockets 80 and 84. Otherwise stated, the side walls 46 and 56 carry at least one polarization member configured to engage only when each electrical connector 32 and 34 is in its desired orientation relative to the other connector. If one of the connectors 32 or 34 is positioned upside down, the at least one polarization member of the polarization assemblies 63 and 67 will interfere with each other, thereby preventing the electrical contacts of the complementary connectors 32 and 34 from mating.

Figure 2C:
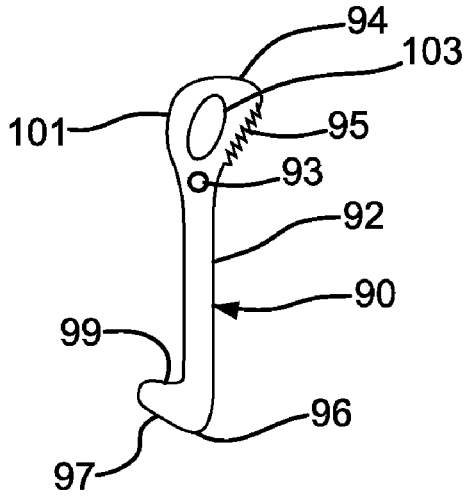
FIG. 2C is a top plan view of a latch of the engagement assembly illustrated in FIG. 2B.

Reference now to FIGS. 2A-C, each securement assembly 69 includes a securement member 91 configured to releasably engage the securement member 89 of the connector housing of the receptacle connector 34. In accordance with the illustrated embodiment, the securement member 91 is illustrated in the form of a latch 90 mounted onto the connector housing 36. In particular, the connector housing 36 includes a bracket 98 that includes a transverse lower bracket wall 98*a*, a longitudinally outer bracket wall 98*b*, and an upper transverse bracket wall 98*c* that extends parallel to the lower bracket wall 84*a*. The front end of the pocket walls 84*a-c* is recessed laterally rearward with respect to the front end 42 of the housing 36.

In accordance with the illustrated embodiment, the upper bracket wall 98*c* is defined by the upper surface 38 of the housing 36, and the lower bracket wall 98*a* is vertically aligned with the divider wall 82. The longitudinally outer end 98*b* also extends between the lower and upper bracket walls 98*a* and 98*c* at a location laterally outward with respect to the laterally outer wall 80*b* of the lower pocket 80. The bracket 98 includes a longitudinally inner end 98*d* that extends vertically between the lower and upper bracket walls 98*a* and 98*c*. The longitudinally inner end 98*d* is open to the contact-retaining void 70.

The latch 90 includes a latch body 92, a handle 94 disposed at the rear end of the latch body 92, and an engagement finger 96 disposed at the front end of the latch body 92. The handle 94 includes a longitudinally outwardly-facing textured grip 95, and an opposing longitudinally inwardly facing surface 101. The engagement finger 96 includes a cam surface 97 that extends longitudinally inward along a rearward direction and terminates at its rear end at a rear catch surface 99 that extends longitudinally between the inner end of the cam surface and the latch body 92. The cam surface 97 is illustrated as curved, but can alternatively be straight or define any other shape as desired, such that the latch 90 is configured to engage the corresponding latch ear 64 of the complementary receptacle connector 34.

The connector 32 includes a vertical pin 93 that extends through the latch body 92, and into the lower and upper bracket walls 98*a* and 98*c*. The latch 90 is thus pivotally mounted to the header connector housing 36 about the pin 93. The inner surface 101 of the handle 94 is compressible. In this regard, the latch 90 can be made from any suitable compressible, preferably dielectric, material. In accordance with the illustrated embodiment, the latch 90 defines a compression aperture 103 that extends vertically through handle 94 at a location between the inner surface 101 and the grip 95. Accordingly, when a longitudinally inwardly directed force is applied to the grip 95 (for instance, when a user presses against the grip 95), the inner surface 101 is brought against the corresponding side wall 46, which compresses the handle 94 and the compression aperture 103, thereby providing a biasing spring force that biases the handle 94 longitudinally inward.

The latch 90 is operable in a first or initial position whereby the inner surface 101 abuts the side wall 46, but is not compressed against the side wall 46. In the initial position, the cam surface 97 protrudes into the upper pocket 84 in a position aligned with the cam surface 66 of the complementary latch ear 64. The latch 90 is operable in a second or latching position, whereby the cam surface 66 rides along the cam surface 97, and biases the cam surface longitudinally outward, which causes the inner surface 101 to compress against the side wall 46. Thus continued engagement of the latches 64 and 90 is against a spring force of the latch handle 94 resulting from the compression of the inner surface 101. In this regard, it should be appreciated that the handle 94 provides a spring member.

The latch is operable in a third or latched position whereby the rear catch surfaces 99 and 68 slide past each other, and the spring force of the handle biases the rear catch surface 99 longitudinally inward into interference with the rear catch surface 68, such that the connectors 32 and 34 are unable to be separated unless the latch 90 is moved into a fourth or unlatching position. In particular, a longitudinally inwardly directed force is applied to the handle 94 (for instance when the user presses against the grip) that causes the inner surface 101 to compress against the side wall 46. When a sufficient inward force is applied to the handle, the rear catch surface 99 is displaced longitudinally outward out of alignment with the complementary rear catch surface 66, and the connectors 32 and 34 can be unmated. Thus the engagement between the latches 90 and 64 prevents the connectors 32 and 34 from being inadvertently separated during use.

It should be appreciated that the handle 94 can alternatively be made from a material that is sufficiently compressible without the compression aperture 103 so as to allow the inner surface 101 to compress against the side wall 46 in the manner described above. Alternatively still, a spring member can be carried by the latch 90, for instance inside the compression aperture 103 or by the pin 94, that biases the inner surface 101 longitudinally outward (and thus the engagement finger 94 longitudinally inward). In this regard, it should be appreciated that the connector 36, and in particular the latch 90, includes a biasing member that applies a force against the engagement finger 94 that biases the finger 94 into engagement with the complementary latch ear 64.

It should be further appreciated that the securement members 89 and 91, or latches 64 and 90, are disposed at a location vertically offset from the vertical midpoint of the respective side walls 56 and 46. Accordingly, the latches 64 and 90 will only engage when the connector housings 36 and 37 are in their proper orientation to mate the complementary power contacts and the complementary signal contacts. In this regard, it should be appreciated that the latches 64 and 90 provide polarization members that prevent the connectors 32 and 34 from being inadvertently separated during use when the connector housings 34 and 37 are properly oriented.

During operation, the connector 32 can be mated with the connector 34 such that the lower pocket 80 receives the lower polarization guide wall 58, and the upper pocket 84 receives the upper guide wall 60. The divider wall 82 is received by the gap 62, and the area upper pocket wall 84*c* is received in the notch 61. Additionally, the cam surface 97 cams over the cam surface 66 of the latch ear 64 until the catch surface 99 snaps over the rear catch surface 68 of the latch ear 64. When it is desirable to separate the connectors 32 and 34, a user may apply an inwardly directed force to the grip 95 against the spring force created by compression of the handle 94 against the side wall 46. The user-applied force causes the latch 90 to pivot about the pin 93, which thereby removes the engagement finger 96 from interference with the associated latch ear 64. The connectors 32 and 34 can then be separated.

It should be appreciated that the securement assemblies 65 and 69 therefore each include at least one securement member configured to engage so as to releasably lock the connectors 32 and 34 in their mated configuration. In accordance with one embodiment, the securement assemblies 65 and 69 only engage when the electrical connectors 32 and 34 are in their desired orientation relative to the other connector. The at least one securement member can be in the form of one or both latches 64 and 90.

It should be appreciated that while the connectors 32 and 34 are illustrated as being a header connector and a receptacle connector, respectively, the connector housings 36 and 37 could alternatively retain receptacle and header contacts, respectively. Furthermore, while the connectors 32 and 34 are illustrated as vertical connectors, one or both of the connectors 32 and 34 could alternatively be constructed as a right-angle connector.

Figures 4A, 4B, 4C, 4D:
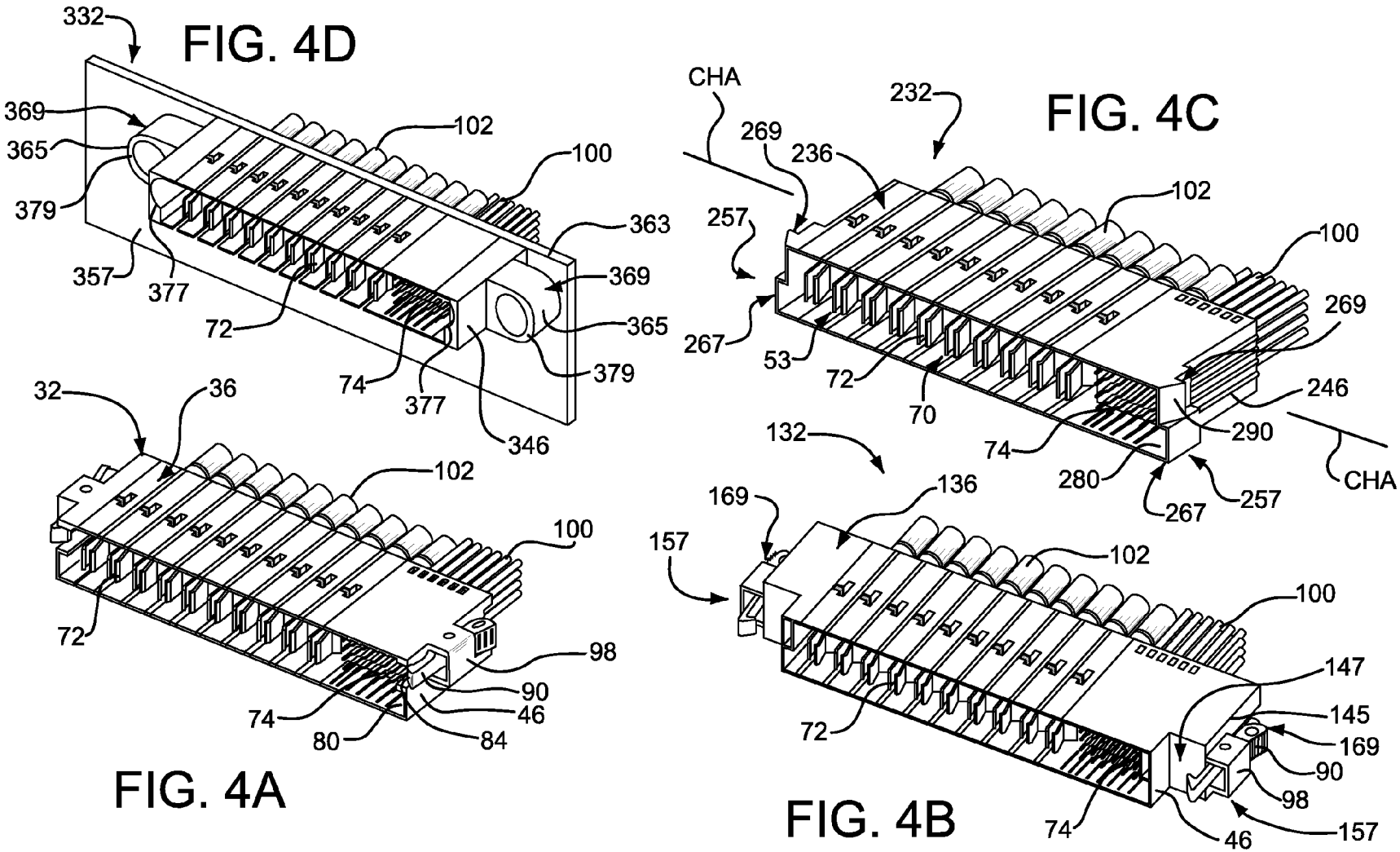
FIG. 4A is a perspective view of the electrical power connector illustrated in FIG. 2.
FIG. 4B is a perspective view of an electrical power connectors constructed in accordance with an alternative embodiment.
FIG. 4C is a perspective view of an electrical power connectors constructed in accordance with another alternative embodiment.
FIG. 4D is a perspective view of an electrical power connector including the connector housing illustrated in FIG. 3F, showing the electrical power connector mounted onto a panel.

While the header connector 32 has been described in accordance with an example embodiment, it is appreciated that it may be desirable to mount a connector similar to connector 32 to a mating connector whose engagement assembly 57 may be different than that of the connector 32 as described above. Furthermore, it may be desirable to provide a connector similar to connector 32 that is particularly adapted to mount onto a panel. FIGS. 4B-4D illustrate electrical header connectors 132, 232, and 332, which include power contacts 72 and signal contacts 74 constructed as described above with respect to electrical connector 32. Each connector 132, 232, and 332 includes respective connector housings that define internal voids that house the contacts 72 and 74, and are constructed as described above with respect to electrical connector 32. In fact, the electrical connectors 132, 232, and 332 can be constructed identically with respect to electrical connector 32, with the exception of the engagement assembly, which can be configured in accordance with alternative embodiments as illustrated.

Figures 5A, 5B, 5C, 5D:
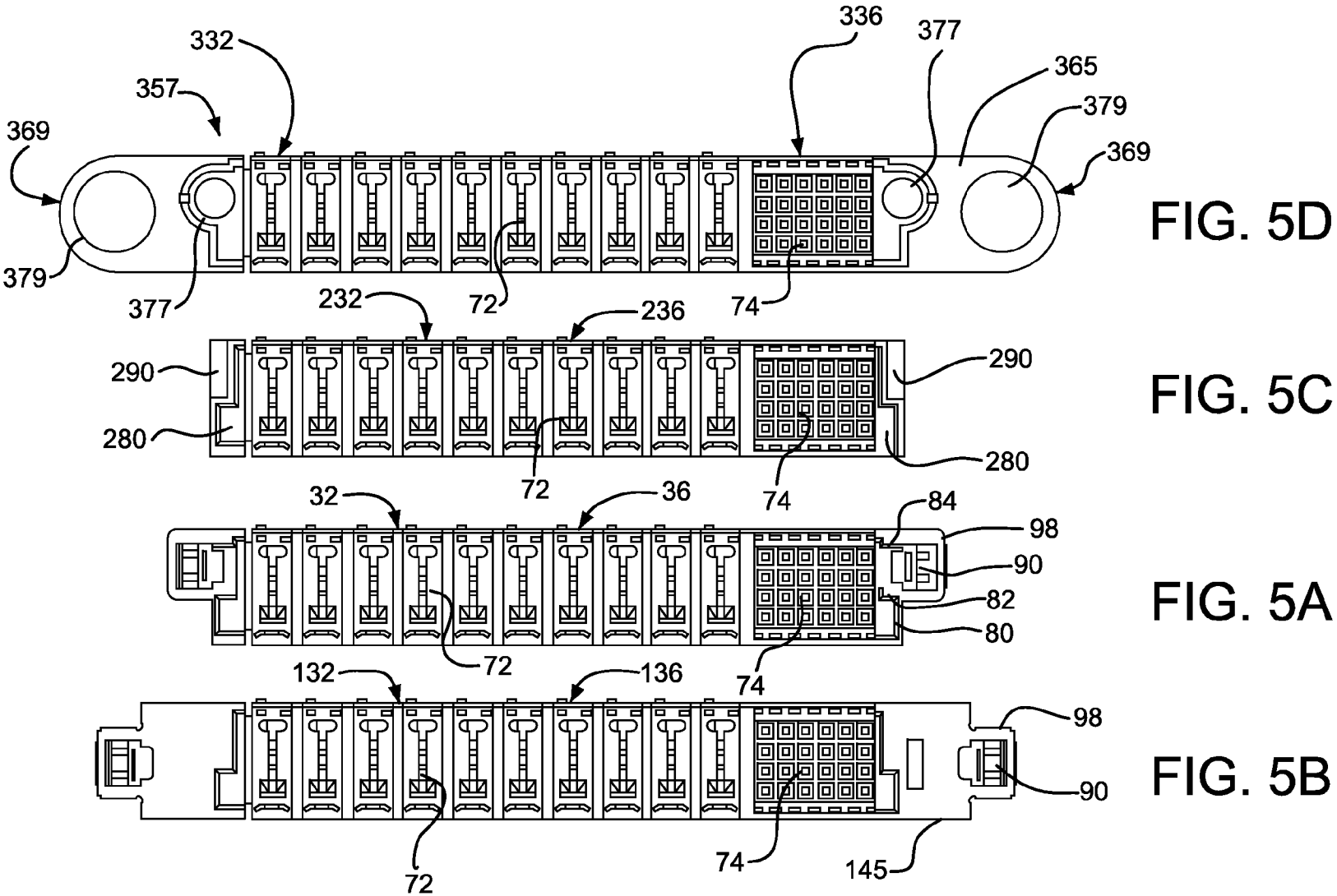
FIGS. 5A-D are front elevation views of the electrical power connectors illustrated in FIGS. 4A-4D, respectively, showing the respective mating interfaces.
Figure 6:
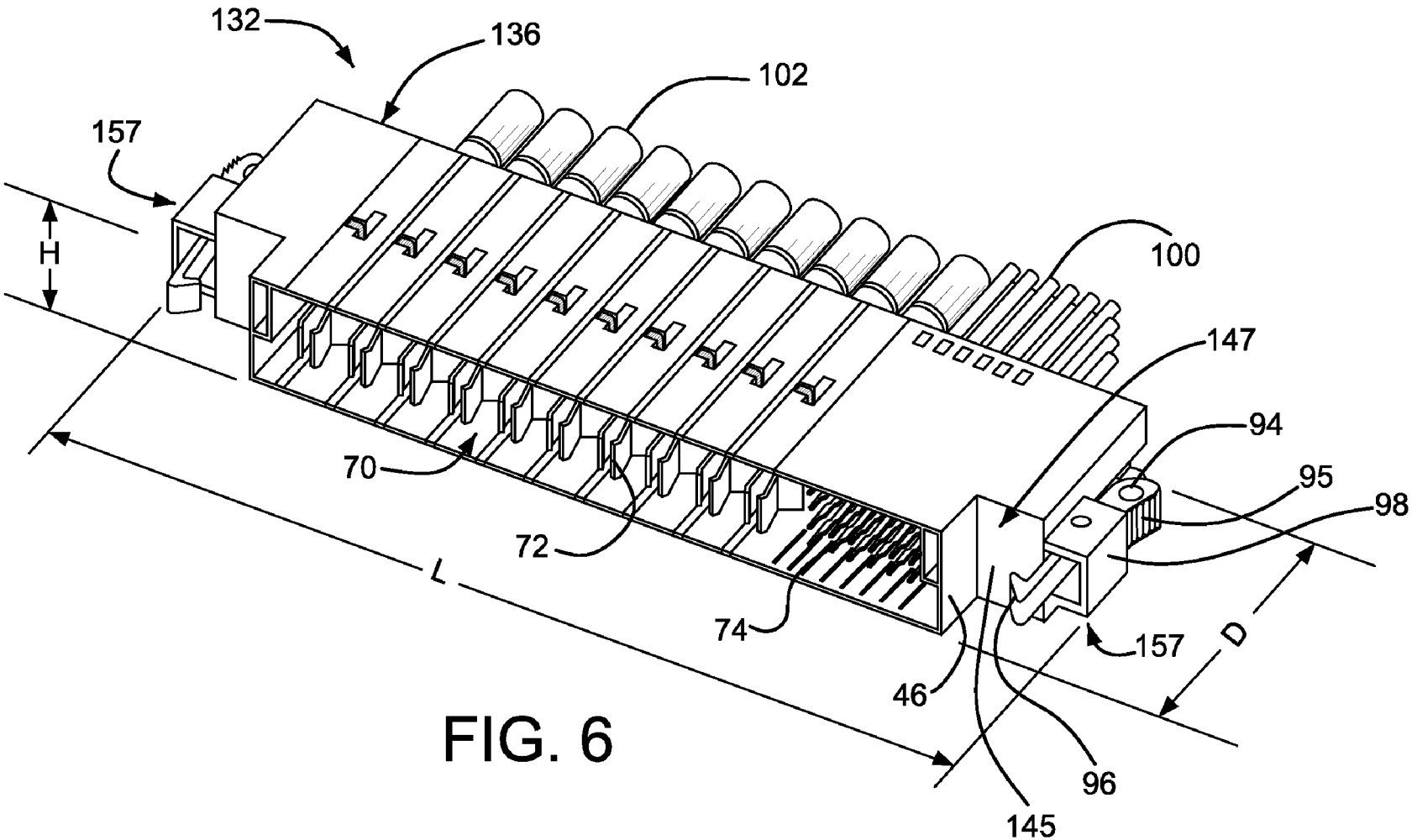
FIG. 6 is an enlarged perspective view of the electrical power connector illustrated in FIG. 4B.

For instance, referring now to FIGS. 4B, 5B, and 6, one alternative embodiment recognizes that the electrical connector 132 includes at least one engagement assembly 157 carried by one of the side walls 146, or carried by each side wall 146 as illustrated), each engagement assembly 157 including a securement assembly 169 but lacks a separate polarization assembly (though it is recognized that the securement assembly 169 can provide a polarization member in the manner described above). The securement assembly 169 includes a securement member in the form of a latch 90 carried by the bracket 98 in the manner described above. The bracket 98 extends longitudinally outward from a mounting block 145 that, in turn, projects longitudinally out from the side wall 146. The front end of the mounting block 145 is recessed with respect to the front end of the connector housing 136 so as to define a pocket in the form of a notch 147 defined by the side wall 146 and the front end of the mounting block 145.

The notch 147 is recessed laterally rearward a sufficient distance such that the upper and lower polarization guide walls 58 and 60 can be received in the notch 147 when the connectors 32 and 34 are mated. Because the notch 147 extends the full height of the connector housing 136, the upper and lower polarization guide walls 58 and 60 can be received in the notch 147 regardless of the orientation of the connector 34 relative to the connector 132. Thus, the notch 147 does not provide a polarization member in the manner described above. The latch 90 extends forward into the notch 147 so as to engage the complementary latch ear 64 when the connectors 132 and 34 as mated in the manner described above when the latch ear 64 is received in the notch 147.

Figure 7:
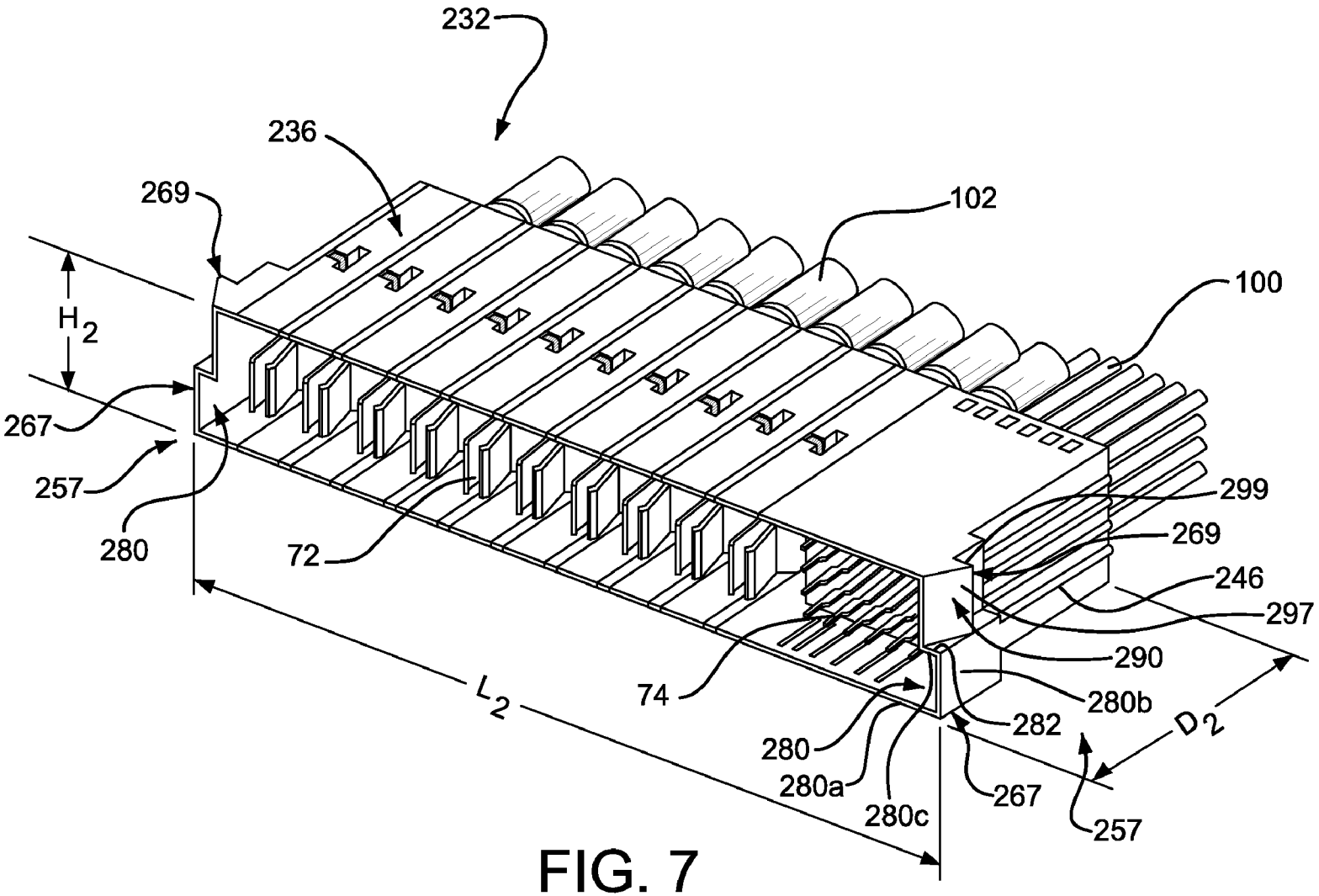
FIG. 7 is an enlarged perspective view of the electrical power connector illustrated in FIG. 4C.
Figure 8D:
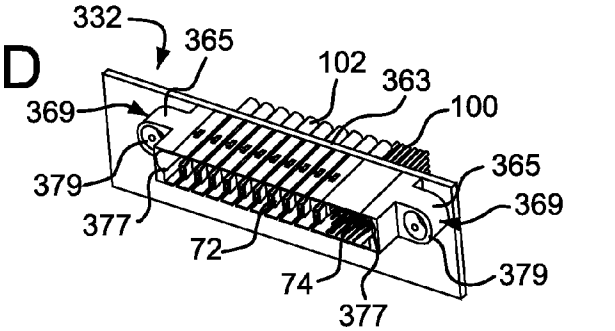
FIG. 8D is a front perspective view of the electrical power connector illustrated in FIG. 8A.
Figure 8E:
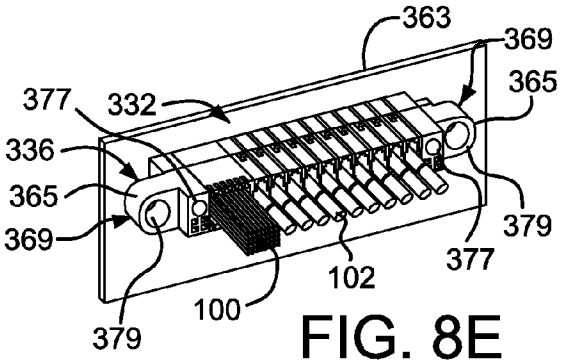
FIG. 8E is a rear perspective view of the electrical power connector illustrated in FIG. 8A.
Figure 8B:
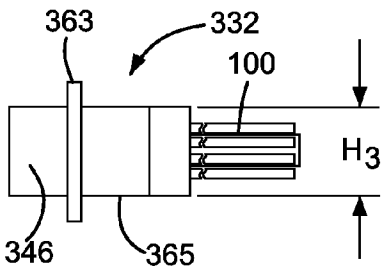
FIG. 8B is a side elevation view of the electrical power connector illustrated in FIG. 8A.
Figure 8A:
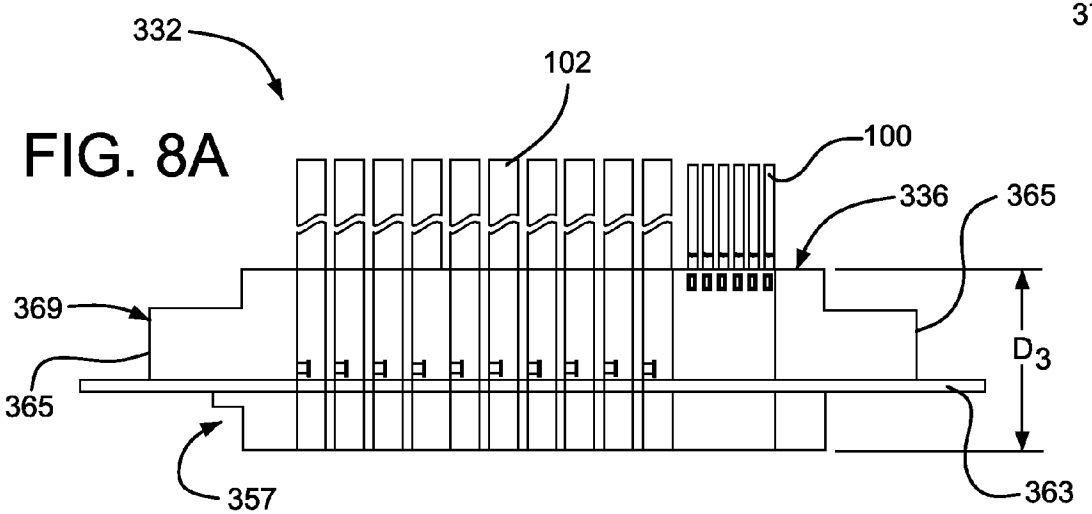
FIG. 8A is a top plan view of the electrical power connector illustrated in FIG. 4D.
Figure 8C:
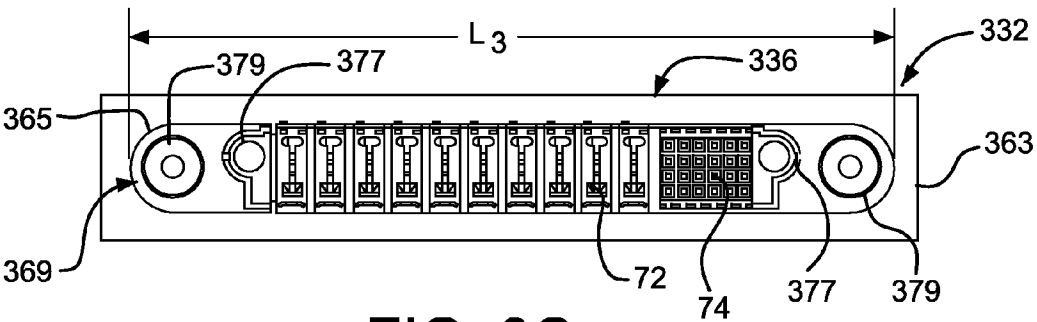
FIG. 8C is a front elevation view of the electrical power connector illustrated in FIG. 8A.

Referring to FIGS. 4C, 5C, and 7, an electrical header connector 232 includes a connector housing 236. The connector housing extends 236 along a connector housing axis CHA between opposed side walls 246 and further comprises a top wall that extends between the opposed side walls 246 so as to define a contact-retaining void 70 between the top wall and the opposed side walls 246, one of the opposed side walls 246 defining a securement assembly 269, such as a latch engagement member, spaced from the top wall of the connector housing 236 and another of the opposed side walls 246 defining polarization member, such as a lower pocket 280, that is spaced farther from the top wall than the latch engagement member. Stated another way, the connector housing 236 further includes at least one engagement assembly 257 that includes a polarization assembly 267 and a securement assembly 269 constructed in accordance with an alternative embodiment. In particular, the polarization assembly 267 includes a polarization member in the form of a lower pocket 280 carried by the side wall 246 and configured to receive a complementary polarization member of an electrical connector configured to mate with the connector 232 in a desired orientation. The securement assembly 269 includes a securement member provided as latch 290 that is integrally formed with (or alternatively mechanically connected to) the side wall 246 at a location above the pocket 280. The latch 290 is separated from the lower pocket 280 by a divider wall 282. The latch 290 includes an angled cam surface 297 that projects longitudinally outward along a rearward direction. The latch 290 includes a rear catch surface 299 that projects longitudinally between the rear end of the cam surface 297 and the side wall 246. The latch 290 is thus configured to engage a securement member of a complementary electrical connector in the manner described above. The header connector 232 is constructed having a longitudinal length that is less than the length of the electrical connector 32. While the height H2 is approximately 15 mm and the depth D2 is approximately 30 mm as described above, the length L2 is approximately 89 mm in accordance with the illustrated embodiment.

Referring now to FIGS. 3F, 4D, 5D, and 8A-E, an electrical header connector 332 constructed in accordance with another alternative embodiment is configured to mount onto a panel 363, which can be vertically oriented. The electrical connector 332 includes at least one engagement assembly 357 that includes a polarization assembly 367 and a securement assembly 369. In particular, the connector housing 336 includes a support wall 365 that extends longitudinally out from each side wall 346. The housing 336 defines an outer generally cylindrical aperture 379 extending laterally into or through each support wall 365, and an inner aperture 377 that extends laterally into or through the housing 346 at a location longitudinally inward with respect to the outer aperture 379. The inner aperture 377 can be sized smaller than the outer aperture 379, and is centered slightly above the outer aperture 379. The inner aperture 377 can be cylindrical in shape, or can be generally round but short of a complete cylinder, or can define any alternative suitable shape as desired. For instance, the inner aperture 377 can be open to the contact-retaining void 70 at its longitudinally inner end.

The electrical connector 332 is thus configured to attach to a mating connector and the panel wall 363 using any suitable mechanical fastener. The front end of the housing 336 can be inserted into an opening extending through the panel 363 until the panel abuts the front end of the support wall 365. The polarization assembly 367 is carried by the support wall 365, and can include one or more pockets, protruding structure, or the like, configured and arranged as desired so as to ensure that the connector 332 mates with a complementary connector in a desired orientation, as described above. In this regard, it should be appreciated that the vertical offset of the apertures 377 and 369 can ensure the desired orientation. The interior void 70 of the housing 336 that retains the signal contacts 72 and power contacts 74 can be divided into a signal contact void 70A and a power contact void, separated by a divider wall 371.

It should be appreciated that the aperture the wall 365 and associated aperture 379 could assume any desired shape suitable for receiving any suitable mechanical fastener (not shown) configured to mount the connector 332 to the panel 363. The connector 332 can define a height H3 of approximately 15 mm and a depth D3 of approximately 30 mm in the manner described above, and a longitudinal length L of approximately 127 mm.

The foregoing description is provided for the purpose of explanation and not limitation. While the invention has been described with reference to preferred embodiments or preferred methods, it is understood that the words which have been used herein are words of description and illustration, rather than words of limitation. Furthermore, the various structure and features of each embodiment as described above can be incorporated into any of the other embodiments described above, unless otherwise noted. Although the invention has been described herein with reference to particular structure, methods, features, and embodiments, the invention is not intended to be limited to the particulars disclosed herein, as the invention extends to all structures, methods and uses, such as are within the scope of the appended claims. Those skilled in the relevant art, having the benefit of the teachings of this disclosure, may effect numerous modifications to the invention as described herein, and changes may be made without departing from the scope and spirit of the invention, for instance as defined by the appended claims.

What is claimed:

1. An electrical power connector configured to mate with a complementary electrical connector, the electrical power connector comprising:

a connector housing extending between opposing side walls so as to define a contact-retaining void;

a plurality of electrical contacts retained in the contact-retaining void, wherein the electrical contacts define respective mating ends configured to mate with complementary electrical contacts of the complementary electrical connector, and the electrical contacts define respective linearly aligned mounting ends configured to couple to respective electrical cable conductors; and an engagement assembly including at least one asymmetrically positioned polarization pocket carried by at least one of the side walls and configured to receive a polarization member of the complementary electrical connector only when the electrical power connector is in a desired orientation relative to the complementary electrical connector, and a latch carried by the at least one of the side walls, the latch configured to releasably engage a securement member of the complementary electrical connector.

2. The electrical power connector as recited in claim 1, wherein the polarization pocket is located vertically asymmetrically.

3. The electrical power connector as recited in claim 1, wherein the polarization pocket defines opposing inner and outer ends, and the polarization pocket is open at its inner end to the contact-retaining void.

4. The electrical power connector as recited in claim 3, wherein the polarization pocket is closed at its outer end.

5. The electrical power connector as recited in claim 3, wherein the polarization pocket is open at its outer end.

6. The electrical power connector as recited in claim 5, wherein the latch is positioned such that an engagement finger of the latch protrudes into the polarization pocket.

7. The electrical power connector as recited in claim 1, wherein the polarization pocket is a lower polarization pocket, and the engagement assembly further comprises an upper polarization pocket disposed above the lower polarization pocket.

8. The power connector as recited in claim 7, wherein the latch protrudes into the upper polarization pocket.

9. The electrical power connector as recited in claim 7, wherein the lower polarization pocket is shaped differently than the upper polarization pocket.

10. The electrical power connector as recited in claim 9, wherein the lower polarization pocket has a height that is greater than a height of the upper polarization pocket.

11. The electrical power connector as recited in claim 10, wherein the upper and lower polarization pockets are separated by a divider wall that defines both an upper wall of the lower polarization pocket, and a lower wall of the upper polarization pocket.

12. The electrical connector as recited in claim 1, wherein the electrical contacts comprise header contacts configured to be received in receptacle contacts of the complementary electrical connector.

13. The electrical connector as recited in claim 1, wherein the engagement assembly is carried by both side walls.

14. The electrical power connector as recited in claim 1, wherein the electrical contacts comprise electrical power contacts disposed in the contact-retaining void, the electrical power contacts having mating ends configured to mate with complementary power contacts of the complementary electrical connector.

15. The electrical power connector as recited in claim 14, wherein the electrical contacts further comprise electrical signal contacts disposed in the contact-retaining void, the electrical signal contacts having mating ends configured to mate with complementary signal contacts of the complementary electrical connector.

16. An electrical power connector configured to mate with a complementary electrical connector, the electrical power connector comprising:

a connector housing comprising a top wall and a bottom wall that is spaced from the top wall, the top and bottom walls extending between opposed side walls so as to define a contact-retaining void that is at least partially defined by the top wall and the opposed side walls, one of the opposed side walls defining a latch engagement member configured to be biased outwardly with respect to the contact-retaining void and spaced from the top wall of the connector housing, the other of the opposed side walls defining a polarization member configured to be received in a complementary polarization member and spaced farther from the top wall than the latch engagement member, the opposed side walls disposed at outer ends of the connector housing such that the opposed side walls are spaced further apart than the top and bottom walls; and a plurality of electrical contacts retained in the contact-retaining void, wherein the electrical contacts define respective mating ends configured to mate with complementary electrical contacts of the complementary electrical connector, and the electrical contacts define respective linearly aligned mounting ends configured to couple to respective electrical cable conductors.

17. The electrical power connector as recited in claim 16, wherein the electrical contacts comprise electrical power contacts disposed in the contact-retaining void, the electrical power contacts having mating ends configured to mate with complementary power contacts of the complementary electrical connector.

18. The electrical power connector as recited in claim 17, wherein the electrical contacts further comprise electrical signal contacts disposed in the contact-retaining void, the electrical signal contacts having mating ends configured to mate with complementary signal contacts of the complementary electrical connector.

19. An electrical power connector configured to mate with a complementary electrical connector, the electrical power connector comprising:

a connector housing that extends along a connector housing axis between opposed side walls so as to define a contact-retaining void, the connector housing further defining at least one polarization pocket at a mating interface of the connector housing;

a securement member supported by the connector housing, the securement member comprising a latch body that is configured to be deflected away from a center of the mating interface when the complementary electrical connector is mated to the electrical power connector; and a plurality of electrical contacts retained in the contact-retaining void, wherein the electrical contacts define respective mating ends configured to mate with complementary electrical contacts of the complementary electrical connector and respective linearly aligned mounting ends configured to couple to respective ones of a plurality of electrical cable conductors.

20. The electrical power connector as recited in claim 19, wherein the plurality of electrical contacts comprise electrical power contacts, and respective ones of the electrical cable conductors are connected to the linearly aligned mounting ends of the electrical power contacts.

21. The electrical power connector as recited in claim 20, wherein the plurality of electrical contacts further comprise electrical signal contacts, and respective ones of the electrical cable conductors are connected to the linearly aligned mounting ends of the electrical signal contacts.

22. The electrical power connector as recited in claim 21, wherein respective ones of the mounting ends of the electrical signal contacts are aligned along a first common axis that is oriented perpendicular to the connector housing axis, and respective ones of the mounting ends of the electrical power contacts are aligned along a second common axis that is parallel to the connector housing axis and perpendicular to the first common axis.

* * * * *